United States Patent [19]

Kato et al.

[11] Patent Number: 4,872,659

[45] Date of Patent: Oct. 10, 1989

[54] CASSETTE WITH TURN COVER AND FEED ROLLER CONTROL

[75] Inventors: Toshio Kato, Okazaki; Kunihiro Uotani, Seto; Mitsuhiko Ito, Toyoake, all of Japan

[73] Assignee: Ricoh Company, Ltd., Tokyo, Japan

[21] Appl. No.: 188,307

[22] Filed: Apr. 29, 1988

[30] Foreign Application Priority Data

Apr. 30, 1987 [JP] Japan ..... 62-107079

[51] Int. Cl.[4] ..... B65H 3/44; B65H 5/26

[52] U.S. Cl. ..... 271/9; 271/111; 271/121; 271/273; 355/309; 355/316

[58] Field of Search ..... 355/24, 3 SH, 14 SH; 271/273, 274, 121, 110, 265, 111, 9

[56] References Cited

U.S. PATENT DOCUMENTS 4,025,187 5/1977 Taylor et al. ..... 355/3 SH X
4,227,800 10/1980 Nezu ..... 355/3 SH X
4,384,712 5/1983 Miyamoto ..... 271/273 X
4,666,281 5/1987 Miyai et al. ..... 355/14 SH X
4,681,425 7/1987 Tanimoto ..... 355/35 SH X
4,734,738 3/1988 Yamanaka et al. ..... 355/24 X
4,743,945 5/1988 Ito et al. ..... 355/14 SH

*Primary Examiner*—A. T. Grimley
*Assistant Examiner*—Robert Beatty
*Attorney, Agent, or Firm*—Oblon, Spivak, McClelland, Maier & Neustadt

[57] ABSTRACT

A cassette holding a sheet of paper is arranged in such a manner that a feed roller feeds the sheet of paper into the main body of a printer, copying machine, etc. in a predetermined direction. The cassette is adapted so that it is inserted into and removed from the main body in a direction which is perpendicular to the predetermined direction within a plane of the fed sheet of paper. A member is fixed at a turn cover at one end so that one sheet of paper present on the feed roller is positioned between the turn cover and the other end of the member in order to draw out a sheet of paper when the turn cover is opened. Also, a special feed roller control operation is provided when the last sheet of paper is fed out.

5 Claims, 24 Drawing Sheets

| $S_1$ | $S_2$ | CASSETTE SIZE |
|---|---|---|
| L | L | NO CASSETTE |
| L | H | LEGAL |
| H | L | LETTER |
| H | H | A4 |

CASSETTE WITH TURN COVER AND FEED ROLLER CONTROL

BACKGROUND OF THE INVENTION

Field of the Invention

This invention relates to image forming apparatuses such as printers, copy machines, printing machines, facsimile machines, etc.

Image forming apparatuses such as various printers, copy machines, printing machines, etc., use removable paper feed cassettes or trays in their paper feed units.

Many use a friction pad type paper feed units to feed, one by one, sheets of papers stacked in the trays. In the paper feed unit, many stacked sheets of papers are pushed against a feed roller by means of a bottom plate with a friction pad, and the uppermost sheet of paper is fed to a predetermined position where the sheet of paper contacts conveyor rollers (resist roller) by rotating the feed roller, then the driving of the feed roller is stopped, thereby rendering the feed roller freely rotatable.

Thereafter, the conveyor rollers are started with a predetermined timing and carries the sheet of paper to an image forming unit for example, a toner image transfer unit located by a photosensitive drum.

The feed roller in such feed unit has an outer periphery made of a material having a large coefficient of friction such as rubber and the friction pad is also made of a material having a large coefficient of friction such as cork or rubber.

Only the uppermost sheet of paper, contacting the feed roller, is arranged to be fed out one by one under such a condition that $$\mu_1 > \mu_2 > \mu_3$$

where $\mu_1$ is the coefficient of friction between the feed roller and a sheet of paper, $\mu_2$ the coefficient of friction between the friction pad and a sheet of paper, and $\mu_3$ the coefficient of friction between sheets of paper.

When the last sheet of paper is to be fed in such a friction pad type feed unit, the sheet of paper is directly pushed against the feed roller by the friction pad. If the feed roller stops and the trailing end of the sheet of paper is not out of the bite of the feed roller and friction pad, the sheet of paper is in a state where the sheet of paper is held on both sides thereof with large frictional force.

When the sheet of paper starts to be fed out of the bite of the feed roller and friction pad, the friction pad starts to push the feed roller directly, and an increasing braking force starts to act on the feed roller. Thus the force to feed the sheet of paper increases rapidly. Therefore, if the conveyance force caused by conveyor rollers is not greater than the braking force, the sheet of paper cannot be conveyed, knocking occurs so that smooth conveyance is not expected, and local image shifts or torsions will be caused in a reproduced image.

If paper jamming occurs in each of the image forming apparatuses such as various printers, copy machines or printing machines for some reason during the formation of an image, the apparatus immediately discharges a dischargeable sheet of paper, stops its operation, and waits until the jammed sheet of paper is removed and a jam release switch is pressed. The operator then opens the cover or removes the cassette and takes out the jammed sheet of paper by pinching it with one's fingers.

It is time-consuming to remove all the jammed sheets of paper present in the paper feed path in the image forming apparatus.

In an image forming apparatus in which a sheet of paper on which an image will be formed is fed out from a cassette or a reversing tray provided at the bottom of the apparatus proper and/or the sheet of paper on which an image is formed is discharged to a discharge tray provided on the top of the apparatus, a paper conveyance unit is provided which conveys a sheet of paper substantially in a U-like bent manner. If a jammed sheet of paper is present at that paper conveyance unit, it is usually bent close to the feed roller or a guide plate, so that it is difficult to pinch away the sheet of paper with fingers, and it takes much time to remove the sheet of paper.

SUMMARY OF THE INVENTION

It is a first object of this invention to provide an image forming apparatus which the operation side of the apparatus can be arranged at the front side of the apparatus, so that the apparatus can be operated easily.

It is a second object of this invention to provide an image forming apparatus which, even if the last sheet of paper in the feed cassette or tray is fed, prevents the inability of the sheet of paper to be fed and non-smooth conveyance of the sheet of paper which would otherwise cause partial shifts or torsions in the image.

It is a third object of this invention to provide an image forming apparatus which is capable of easily removing a jammed sheet of paper.

The first object of this invention is attained by a first apparatus for forming an image on a sheet of paper comprising; a main body, a storing means for storing a sheet of paper therein, and a feeding means for feeding said sheet of paper in said storing means into said main body in a predetermined direction, said storing means being adapted to be inserted into and removed from said main body in a perpendicular direction perpendicular to said predetermined direction within a plane of said fed sheet of paper.

According to the first apparatus of this invention, the operation side of the apparatus can be arranged at the front side of apparatus, so that the apparatus can be operated easily.

The second object of this invention is attained by a second apparatus for feeding a sheet of paper, comprising; a bottom plate storing a plurality of stacked sheets of paper, a feed roller for feeding an uppermost sheet of paper among said stacked sheets of paper by a rotation thereof to a predetermined position corresponding to a conveyor roller, a pressing means for pressing said stacked sheets of paper against said feed roller through a friction pad disposed at said bottom plate, a first sensing mean for sensing that said fed sheet of paper reaches to said predetermined position, a second sensing means for sensing that the last sheet of paper on said bottom plate is fed out, and a controlling means for controlling said feed roller such that said feed roller is stopped and allowed to rotate freely after said first sensing means senses that said fed sheet of paper reaches to said predetermined position, and that said feed roller is rotated again by a set time interval or by a set angle when said second sensing means for sensing that the last sheet of paper on said bottom plate is fed out.

According to the second apparatus of this invention, even if the last sheet of paper in the bottom plate is fed, the inability of the sheet of paper to be fed and non-smooth conveyance of the sheet of paper which would otherwise cause partial shifts or torsions in the image is prevented.

The third object of this invention is attained by a second apparatus for forming an image on a sheet of paper, comprising a cover for opening and closing a paper conveyor unit, and a member disposed at said cover for engaging a sheet of paper present on said paper conveyor unit and drawing out said sheet of paper when said cover is opened.

According to a third apparatus of this invention, a jammed sheet of paper is easily removed.

DETAILED DESCRIPTION OF THE PREFERRED EMBODIMENTS

An embodiment of this invention will now be described in more detail. Various changes and modifications are possible by those skilled in the art without departing from the scope of this invention defined clearly in the accompanying claims.

Figure 1:
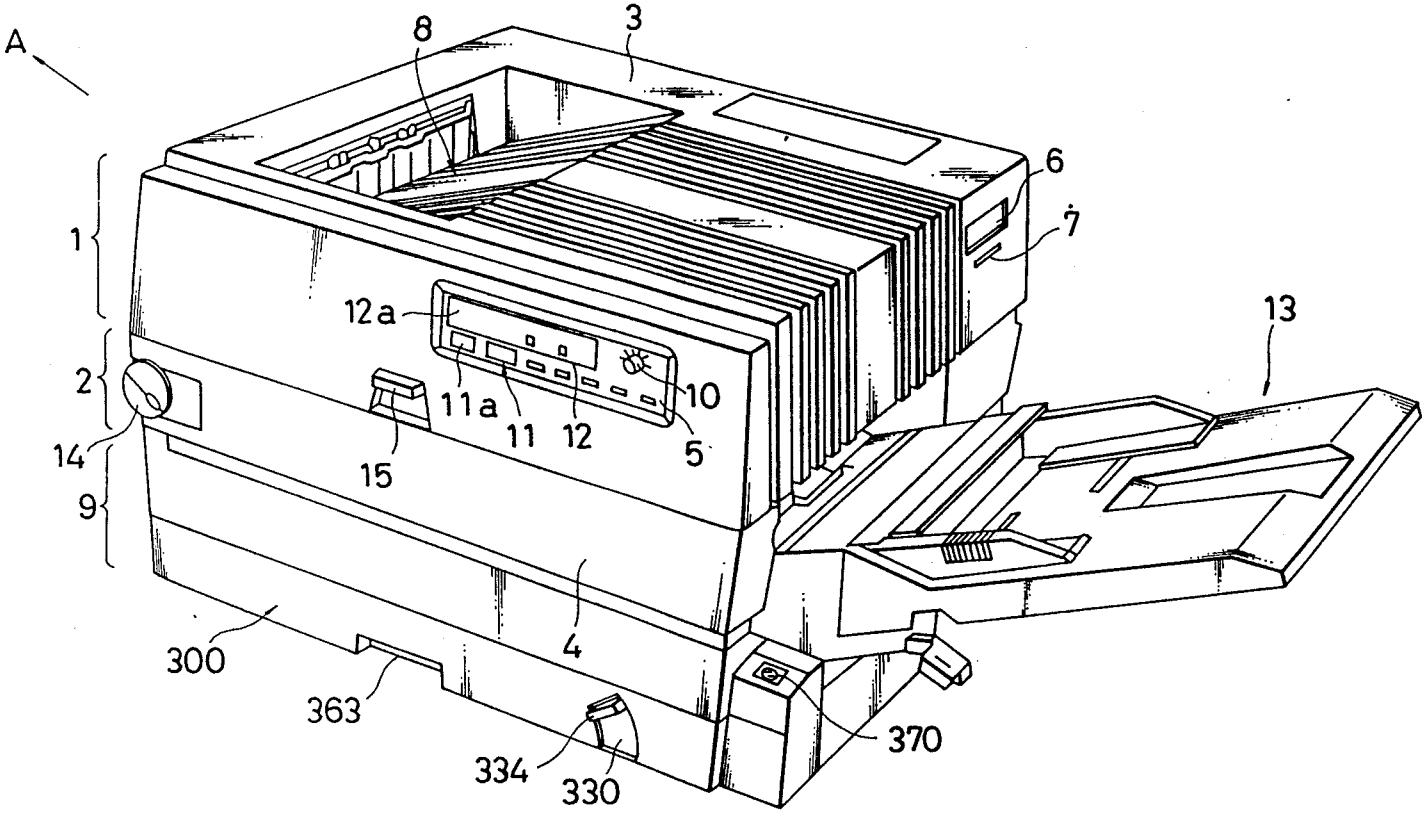
FIG. 1 perspective view of one embodiment of an image forming apparatus according to this invention.

FIG. 1 is a perspective view of one embodiment of a laser printer as the image forming apparatus in which this invention is carried out. The laser printer has a function of forming (printing) an image on various sheets of recording paper or envelopes in accordance with image information and other control information given in character codes and/or image data from hosts, for example, various information processing devices such as a word processor, a personnel computer, an office computer, a data processor, a work station and an image editing device.

The laser printer includes the printer proper dividable into an upper unit 1 and a lower unit 2, and an option tray 9 which is an automatic paper feed unit installed below the lower unit 2. An image forming mechanism forming an image and a control unit controlling the image forming unit, both being described in more detail later, are accommodated within a cover 3 of the upper unit 1 and within a cover 4 of the lower unit 2. The apparatus further includes a paper feed mechanism capable of feeding a sheet of paper automatically or manually form a paper feed tray 13. With an option tray 9 being mounted below, three-way paper feed is possible.

The cover 3 of the upper unit 1 has an operation panel 5 on the front thereof. The apparatus has a font cartridge inlet 6 and an emulation card inlet 7 formed on the rearward right-hand side thereof, and an upper discharge paper tray 8 which stocks discharged sheets of paper on top of the apparatus.

The operation panel 5 has a paper size selective switch 10 of a rotary type which designates the paper size to the printer, a switch group 11 includes a switch 11*a* selecting the lower unit 2 (on the printer side) or an option tray 9 as the feed tray and also switches giving various other commands, and a display group 12 which includes light emitting diodes (LEDs) displaying various error statuses such as the exchange of the photosensitive drum, paper end, jamming, toner end and paper size. The font cartridge inlet 6 is used to receive a font cartridge which includes a RAM or ROM which stores a character font. The emulation card inlet 7 is used to receive an emulation card which is used to achieve the matching between the host and the printer in accordance with the type of the host.

A paper feed tray 13 which accommodates sheets of paper is removably attached to the right-hand side of the lower unit 2. A paper discharge switching knob 14 is provided on the left-hand front of the apparatus for changing the discharging direction of the sheet of paper, to the outer left-hand of the printer (in the direction of arrow A) or toward the upper discharge tray 8.

The upper unit 1 and lower unit 2 are hinged at their backs and locked to each other by a lock mechanism disposed near the front of the apparatus. By lifting a lock lever knob 15 protruding from the front cover 3, the lock mechanism is unlocked, and the upper unit 1 may be turned away from the lower unit 2 in order to service the apparatus and exchange parts.

The option tray 9 has a paper feed cassette 300 which has a finger access 363 provided at the center thereof and a cassette unlocking lever 334 extending outwardly from a sectoral opening 330 in the cassette.

A power indicator lamp 370 for the option tray includes a green LED which is lit when the power source is turned on.

Figure 2:
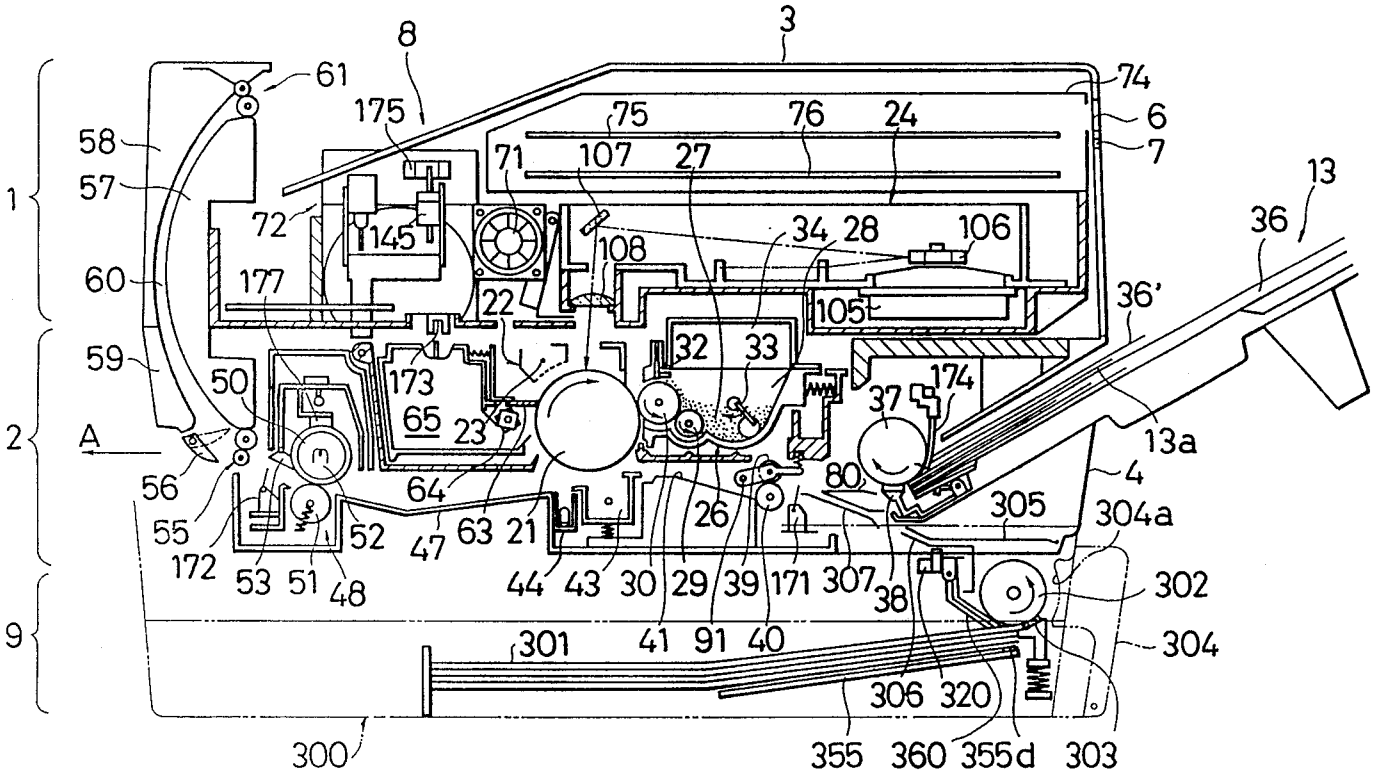
FIG. 2 is a schematic of an image forming mechanism and a paper feed unit of the embodiment.

FIG. 2 is a schematic of an image forming mechanism and the paper feed unit of the laser printer. The laser printer rotates a photosensitive drum (OPC drum) 21, disposed substantially at the center of the lower unit 2, in the direction of the related arrow by a main motor (not shown) when printing starts.

At this time, the surface of the photosensitive drum 21 is uniformly charged by the discharging of a charge wire 23, extended parallel to the photosensitive drum 21, toward charger 22. The laser write unit 24 radiates a scanning laser beam, modulated in accordance with a written image from a semiconductor laser (not shown), onto the photosensitive drum 21 via a mirror 107 and a cylindrical lens 108 by a polygon mirror 106 rotated by a motor 105. An electrostatic latent image is formed onto the photosensitive drum 21 in accordance with the written image by the axial main scanning of the photosensitive drum 21 and by the tangential subscanning of the photosensitive drum 21 due to rotation of the photosensitive drum 21 itself in the direction of the related arrow.

A developing unit 26 is of a contact developing system which deposits toner 27 onto the latent image on the photosensitive drum 21 to visualize the latent image as a toner image. In the developing unit 26, toner 27 contained in a toner container 28 is supplied to a developing roller 30 by a toner supply roller 29 rotated in the direction of the related arrow. A toner layer thickness control blade 32 maintains constant the thickness of the toner layer on the outer surface of developing roller 30. The developing roller 30 is rotated in the direction of the related arrow while contacting the photosensitive drum 21 lightly to thereby deposit toner 27 onto the photosensitive drum 21.

The developing unit 26 has a stirring plate 33 which stirs toner 27, contained in the container 28, and a toner cartridge 34 above the container 28.

When the paper feed tray selection switch the operation panel 5 selects the printer-proper side (paper tray 13) to start the printer, the uppermost one of sheets of paper 36 resting on the tray 13 is separated by a feed roller 37, which rotates in the direction of the related arrow, and is fed over a V-like paper guide 80 into the bite of the upper and lower conveyor rollers 39 and 40 which then feeds the sheet of paper via a conveyor surface 41 to a transfer position. The axis 91 supports a lever holding the roller 39.

The sheet of paper is then brought into contact with the photosensitive drum 21 at the transfer position so as to overlap over the toner image, and a predetermined voltage is applied to a transfer charger 43 with a predetermined timing so that the toner image on the photosensitive drum 21 is transferred to the sheet of paper.

Immediately after the transfer process is completed, a charge removal lamp 44 which includes light emitting diodes (LEDs) disposed downstream of the transfer charger 43 illumines the sheet of paper and the photosensitive drum 21 through the sheet of paper. This eliminates the remaining charges on the photosensitive drum 21 and the charges on the sheet of paper collected during the passage of the sheet of paper so that the sheet of paper can be separated from the photosensitive drum 21 by its own weight.

The thus separated sheet of paper is then delivered via a conveyance surface 47 into the bite of a heating roller 50 and a pressure roller 51 of the fixing unit 48.

The roller 50 has a heater 52 therein for heating the roller 50 which cooperates with the pressure roller 51 to heat and press a sheet of paper to thereby fuse and fix the toner image onto the sheet of paper. The roller 50 has a surface made of a conductive material of Teflon (trade name) mixed with carbon and eliminates the charges on a sheet of paper during the fixing process to thereby improve the stackability of the discharged sheets of papers.

The fixed sheet of paper is separated from the roller 50 by a separating pawl 53 and fed to discharge rollers 55. A paper discharge switching pawl 56 is provided downstream of the rollers 55. The pawl 56 is turned in conjunction with the paper discharge switching knob 14 shown in FIG. 1 between the position shown by the solid line and the position shown by the broken line in FIG. 2 by rotating the knob 14.

When the pawl 56 is at the position shown by the solid line, a sheet of paper discharged from the roller 55 is delivered in an inverted state by an upper roller 61 onto the upper discharger tray 8 by means of a conveyor path 60 which is formed by discharge guides 57, 58 and 59 (with the sheet of paper facing down). When the pawl 56 is at the position shown by the broken line, the sheet of paper discharged from the roller 55 is delivered as it is in the direction of arrow A (with the sheet of paper facing up).

While it is optional which discharge mode is selected, the facing down mode in which the sheets of paper facing down are stacked in the order of pages is suitable for handling ordinary sheets of paper while the facing up mode in which sheets of paper facing up are stacked in a inverted page order is suitable for handling ordinary sheets of paper as well as relatively firm sheets of paper such as sheets of paper for envelopes.

Under a condition in which a sheet of paper 36 is placed on the tray 13 and when a single sheet of paper 36' having a different size is to be placed, for example manually, to obtain a print, the sheet of paper 36' is inserted on the upper portion of a manual supply guide **13*a* provided removably on the tray 13 to thereby temporarily release the pressure of the roller 37 against the sheets of paper 36. Then the roller 37 is again pressed against the sheets of paper 36 and printing is started. The sheet of paper 36' inserted manually on the guide 13*a* is delivered over the guide 80 by the roller 37** to the transfer position, and the next and subsequent sheets of paper 36 in the tray 13 are then delivered sequentially to the transfer position as in the above-described manner, subjected to the predetermined fixing processing and discharged out by the roller 55.

When the option tray 9 is selected by the option tray selective switch 12*a* on the operation panel 5 to thereby start printing, sheets of paper 301 in the paper cassette 300 are delivered one by one by rotation of a feed roller 302 in the direction of the related arrow by the frictional force of friction pads 303 and 355*d*.

The sheet of paper is compulsively inverted along an arcuate guide portion 304*a* of the turn cover 304 and guided by means of the conveyor passageway formed by an upper guide plate 305 and a paper guide stay 306, via the conveyor passageway between the paper guide 80 and a lower paper guide 307 of the lower unit 2 into the bite of the rollers 39 and 40. The sheet of paper is then conveyed to the predetermined transfer position as in the feed of a sheet of paper from the tray 13.

When the sheet of paper is delivered by either one of the above methods and subjected to the transfer processing, the toner remaining on the surface of the photosensitive drum 21 is removed by a cleaning blade 63 in order to prepare for the next image forming process. The toner removed from the photosensitive drum 21 is fed by a toner collecting roller 64 and collected by a toner collecting container 65.

Provided up within the cover 3 of the upper unit 1 is an electronic-unit chassis 74 on which a main control substrate 75 is mounted which constitutes a control unit for the laser printer and a character control substrate 76 which constitutes a character controller.

In FIG. 2, reference numeral 71 denotes an ozone fan; 72, a suction fan unit; 171, a resist sensor which senses that a sheet of paper is fed to a position where the sheet of paper abuts on the rollers 39 and 40; 172, a paper discharge sensor which senses the discharge of a sheet of paper from the fixing unit 48; 173, an over toner sensor; 174, a paper end sensor which senses the presence/absence of a sheet of paper on the sheet tray 13; 175, a latch sensor which senses the operation of a latching solenoid 145; and 177, a fixing temperature sensor.

A paper end sensor 320 of the option tray senses the presence/absence of a sheet in the sheet cassette 300 using the turning operation of a filler 360.

Figure 3:
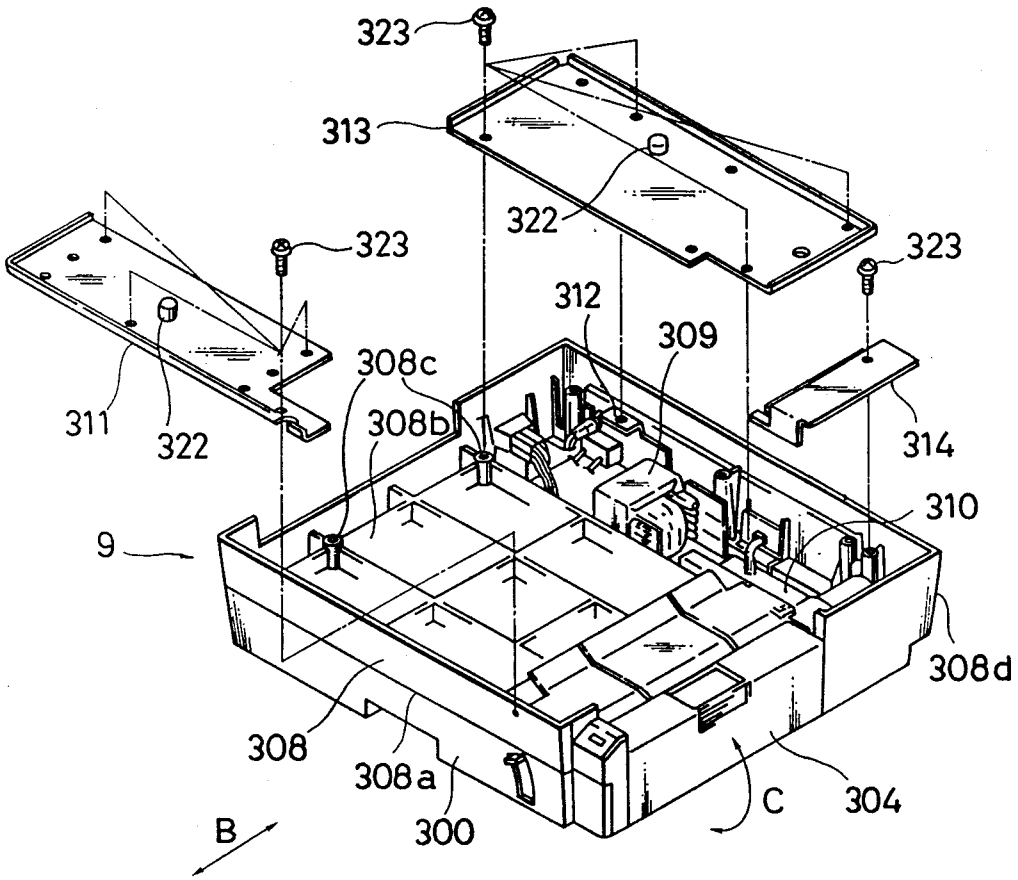
FIGS. 3 and 4 are different perspective views of an option tray as is viewed from its front end and back end, respectively.

The option tray 9 will now be described in more detail with reference to FIG. 3 and subsequent Figures. As shown in FIG. 3, the option tray 9 has an inlet 308*a* below a case 308 through which the paper cassette 300 is inserted into and removed from the cassette accommodating case 308 in the directions of a two-headed arrow B (perpendicular to the direction in which- sheets are fed). The option tray 9 also has a turn cover 304 on that portion of the right-hand side thereof nearer the front of the tray. The cover 304 is pivoted at the lower edge of the side thereof so as to be turnable in the direction of two-headed arrow C. The tray 9 also has on its rear bottom a power supply 309 which supplies DC voltages, and a control board 310 which includes a microcomputer which performs various control operations on the option tray 9.

A plurality of spaced bosses 308*c* which act as a fixing seat is formed on an upper case surface 308*b* slightly lower than the top of the peripheral walls of the case 308. An upstanding bracket 312 is fixed to the rear bottom. A forward upper plate 311, a rearward upper plate 313, and a rear cover 314 are fixed by a plurality of tapping screws 323 to the seats 308*c* and bracket 312, respectively.

The option tray 9 is positioned onto the lower unit 2 such that upward positioning protrusions 322 on the upper plates 311 and 313 mate with positioning recesses (not shown) provided on the lower unit 2.

Figure 4:
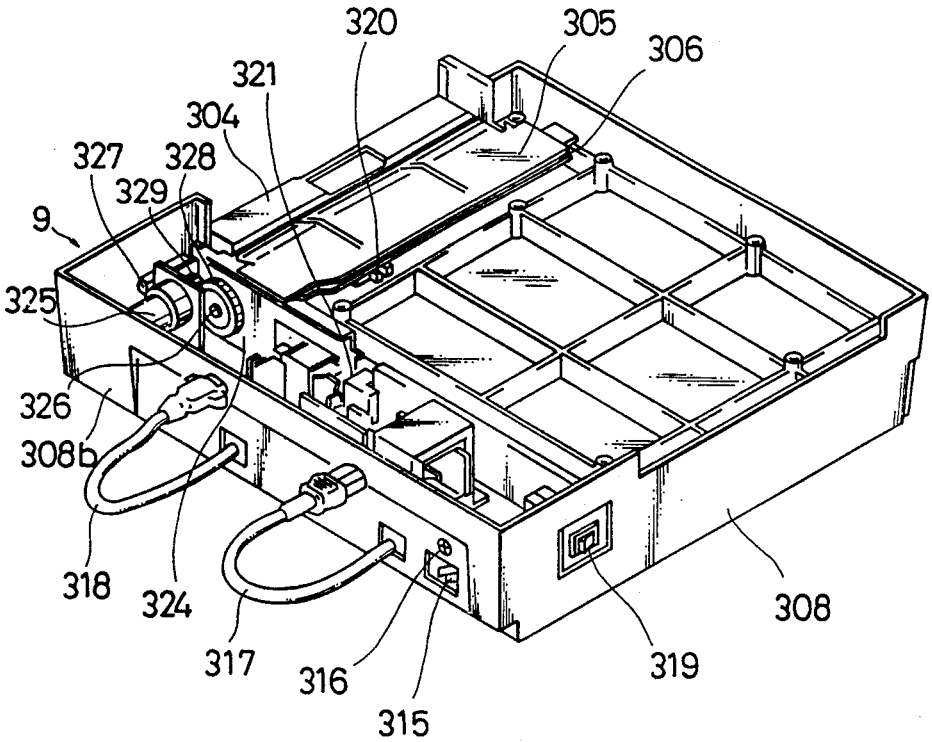

Provided on the back 308*d* of the case 308, as shown in FIG. 4, are an AC input receptacle 315 which provides power to the option tray 9, a fuse holder 316 which accommodates fuses to protect the circuit from an overcurrent, an AC cable 317 connected to a connector (not shown) provided on the lower unit 2 to supply power to the printer proper, and an interface cable 318 through which a microcomputer provided on the printer proper serially transmits a signal periodically to ascertain, for example, whether the option tray 9 is mounted. A power switch 319 is provided on a side adjacent the side 308*d* in order to turn on and off an AC power source to the option tray 9.

As shown clearly in FIG. 4, provided at predetermined positions on the case 308 are a paper end sensor 320 which senses the presence/absence of a sheet, a cassette size sensor 321 which senses the respective sizes of various sheets in the feed cassette 300 and the presence of the cassette itself, both the sensors 320 and 321 each being a photosensor, and a pulse sensor 327 which senses the rotational speed of a feed motor 325 to be described in more detail later.

Provided adjacent to the turn cover 304 in a direction in which a sheet of paper is fed are the guide plate 305 and paper guide stay 306 which are spaced at a distance suitable for conveying a sheet of paper therebetween such that one end of each of the guide plate 305 and guide stay 306 is fixed to the case 308 through a frame 324. A DC feed motor 325 is fixed to the frame 324 with its output shaft being held horizontally. Rotatably coupled to the output shaft of the feed motor 325 is a feed roller shaft 326 on which a feed roller 302 (FIGS. 2 and 5) made, for example, of rubber having a large coefficient of friction via a drive gear wheel 329 and a paper feed gear wheel 328 such that the feed roller shaft 326 is rotated at a low speed compared to and by the rotation of the feed motor 325 to thereby rotate the feed roller 302 in the direction of the related arrow in FIG. 2.

Figure 5:
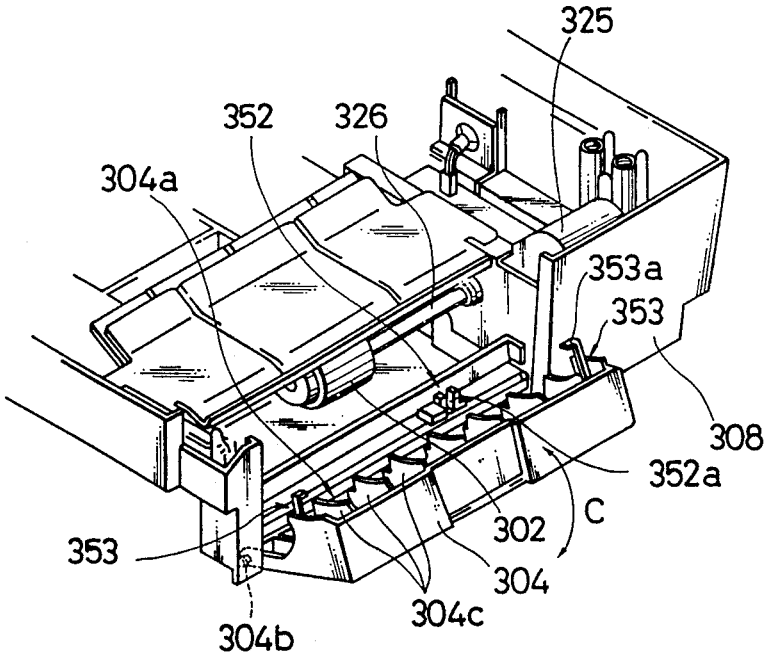
FIG. 5 is a perspective view of a turn cover and its neighborhood.

The elements associated with the turn cover 304 will now be described in detail with reference to FIGS. 5 to 8. As shown in FIG. 5, the turn cover 304 has a pivot 304*b* provided at each end of the lower edge of the turn cover 304 (only one end is shown) and inserted into the case 308 such that the turn cover 304 can be turned in the directions of a two-headed arrow C. A multiplicity of ribs 304*c* (seven in the particular embodiment) each having an arcuate upper left inside end edge is arranged at intervals to thereby form a guide 304*a*.

Figure 6A:
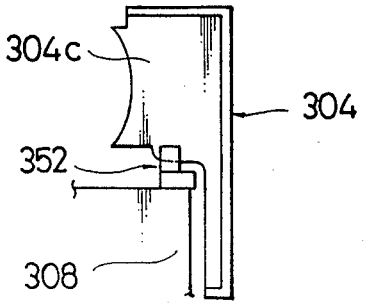
FIGS. 6*a* and 6*b* are side views of closed turn covers, respectively.
Figure 6B:
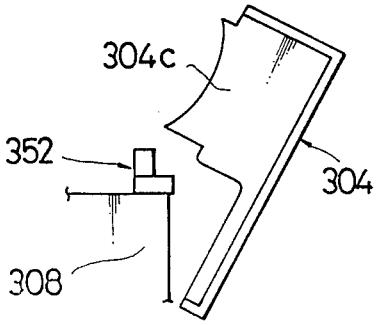

As shown in FIG. 6*a*, one of the ribs 304*c* is arranged to be inserted into a sensor groove 352*a* in a cover sensor 352 which includes a photosensor fixed to the bottom of the case 308 when the turn cover 304 is closed. The cover sensor 352 determines whether the rib 304*c* is inserted into the sensor groove 352*a* in order to detect the closed/open state of the cover. As shown in FIG. 6*b*, when the rib 304*c* is out of the groove 352*a*, the open state of the cover is detected due to the passage of light and feeding a sheet is prevented.

Figure 7:
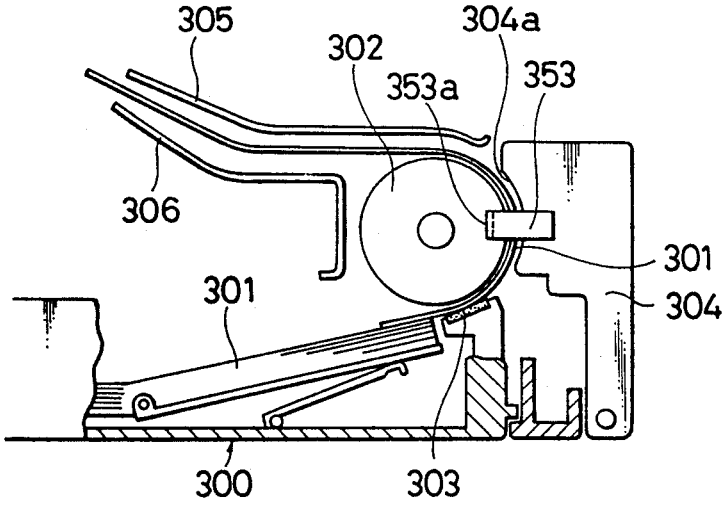
FIGS. 7 and 8 are partially cross sectional front views of a paper conveyor, illustrating different states in which a sheet of paper is jammed and in which the jammed sheet of paper is being removed.

Fixed to the side of the turn cover 304 are L-like pieces 353 for pulling out the sheet of paper 301 such that their bent portions 353*a* oppose each other and are positioned within the space defining the end surfaces of the feed roller 302, as viewed in FIG. 7, when the turn cover 304 is closed (used).

Thus usually in use, a sheet of paper 301 fed by the feed roller 302 from the feed cassette 300 to the guide 304*a* of the turn cover 304 passes between the upper guide plate 305 and paper guide stay 306 without interfering with the L-like piece 353 and via the conveyor passageway between the paper guides 80 and 307 of the printer proper shown in FIG. 2 into the bite of rollers 39 and 40.

Figure 8:
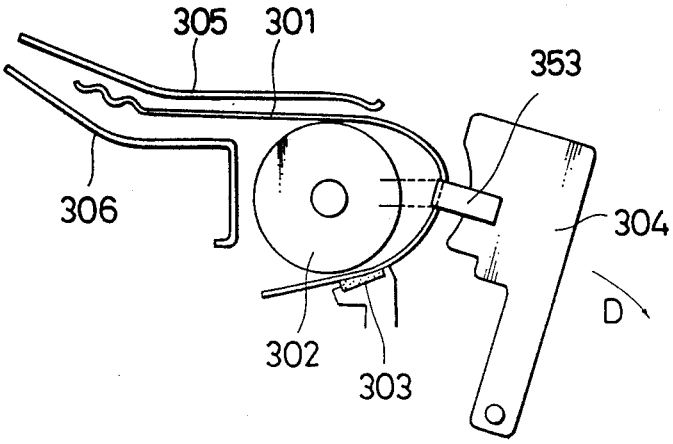

If an abnormality should occur and thus a sheet of paper 301 is jammed, so that the sheet of paper stops at a position, for example, shown in FIG. 7, and is not fed ahead of the rollers 39 and 40 (FIG. 2), the turn cover 304 may be opened in the direction of arrow D as shown in FIG. 8. This causes the bent portions 353*a* of the L-like pieces 353 to engage the jammed sheet of paper 301 on both sides to pull out the sheet of paper away from the feed roller 302 to thereby easily allow the jammed sheet of paper to be taken out.

The L-like pieces 353 may be provided at positions where they can engage a sheet of paper having a minimum width used. They may also be provided movably such that the distance between them adjust to the width of a sheet of paper used. Alternatively, the L-like pieces may be beforehand provided integrally with the turn cover 304.

Figure 9:
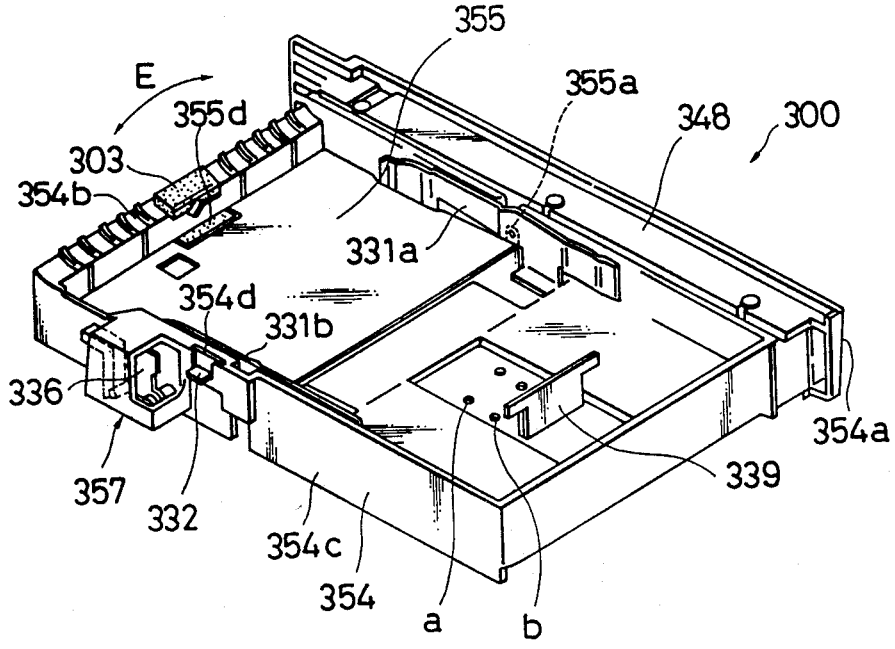
FIG. 9 is a perspective view of an option paper feed tray as viewed from the back thereof.

The details of the paper feed cassette 300 will now be described in more detail with reference to FIG. 9. The cassette 300, the back of which is shown in a perspective view in FIG. 9, is adapted to be mounted in the option tray 9. A bottom plate 355 which occupies about half of the bottom of a box-like cassette case 354 open at the upper end thereof is connected at each end of one edge by a hinge 355*a* (only one is shown) to the corresponding sides of the cassette case 354 such that the bottom plate can be turned in the directions of a two-headed arrow E while a friction pad 355*d* made of cork adheres to the center of the other edge of the bottom plate 355.

A space is provided in a rear wall 354*c* of the cassette case 354 on the rear side of the cassette 300 and covered with a lid . Accommodated within the space is a cassette lock mechanism 357 which is connected via a shaft 333 supported at the bottom of the cassette case to a latch plate 336 mounted outside the rear wall 354*c*. The wall 354*b* of the cassette on the paper take-out side is thicker than the wall 354*c* and has an arcuate upper end. A multiplicity of thin spaced ribs are disposed on the upper end of the wall 354*b*. A friction pad 303 is mounted on a pad holder which is disposed in a notch on the central top of the wall 354*b*, and biased upwardly by a spring in order to prevent the delivery of double sheets of paper, to be described in more detail later.

Provided inside walls 354*a* and 354*c* are paper edge guides 331*a* and 331*b* in opposed relationship to guide the forward sides of sheets of paper accommodated in the cassette case 354. Three pairs of holes a, b, c are provided in the bottom portion different from the bottom plate 355 and a back fence 339 is removably inserted in the holes in order to guide the rear edge of the sheets of paper (the holes c are not shown because the back fence 339 is inserted in the holes c). A groove 354*d* is formed at an upper edge of the wall 354*c* adjacent to the latch plate 336 of the wall 354*c* to allow a cassette size subsensor 332 to be inserted into the groove.

Figure 10:
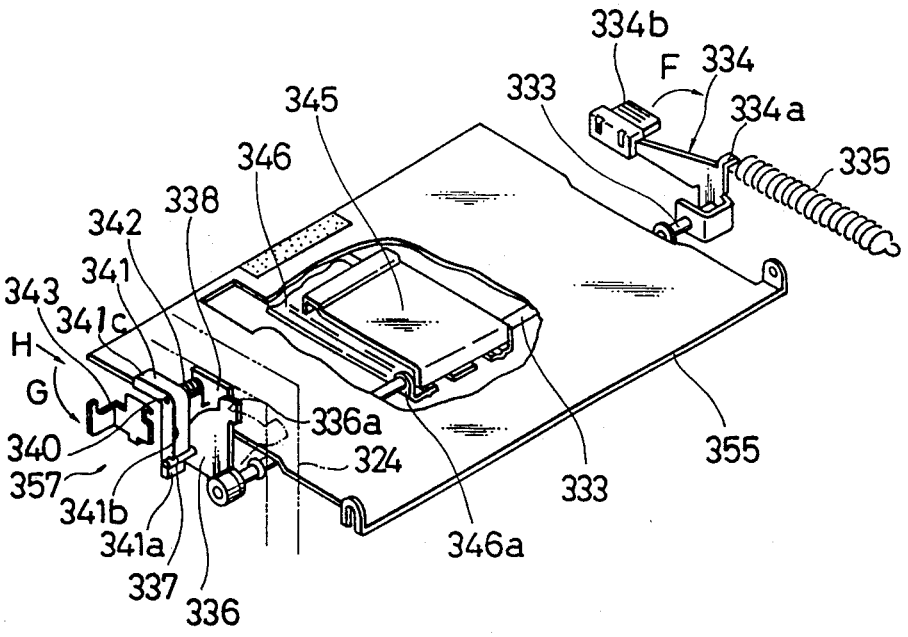
FIG. 10 is a perspective view of a cassette lock mechanism.

As shown in FIG. 10, the cassette lock mechanism 357 is supported by the bottom of the cassette case 354. A release lever 334 is fixed to one end of the long shaft 333 on the front operation side reaching from the wall 354*a* to the wall 354*c* with an operation knob 334*b* being fixed to an end of the lever 334. A coil spring 335 is engaged at one end with a pawl 334*a* formed at an upper end of the lever 334 and at the other end with the front wall 354*a* of the cassette case to urge the release lever 334 at all times to thereby rotate same in the direction of arrow F.

Fixed to the other end of the shaft 333 is a sectoral latch plate 336 having a stop 336*a* at its upper end. A vertical lock pin 337 is fixed parallel to the shaft 333 at a position in the vicinity of the outer periphery of the latch plate 336 spaced from the stop 336*a*. Therefore, the latch plate 336 is arranged to be turned in conjunction with the movement of the lever 334 in the direction of F or in the reverse direction.

A support piece 338 is fixed to the bottom of the cassette case 354 parallel to the latch plate 336. A support pin 340 is provided parallel to the shaft 333 on the upper portion of the support piece 338 and supports the bent middle portion of the L-like lock lever 341 such that the lever 341 can be turned around the pin 340.

The lock lever 341 is always urged so as to be rotated in the direction of arrow G by a spring 342 engaged with the support pin 340 provided between the lever 341 and the piece 338. A groove 341*a* is provided on the lock pin 337 side of the lower portion of the lock lever 341 such that when the pin 337 is rotated in the direction of arrow F from the position of FIG. 10 and then returned in the direction reverse to the arrow F, the pin 337 is slid along the guide surface 341*b* of the lock lever 341 to thereby be engaged in the groove 341*a* as shown.

Figure 11A:
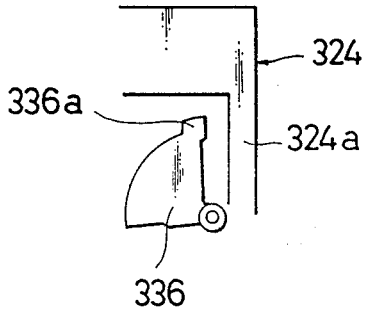
FIGS. 11*a* and 11*b* are different front views of a latch plate and a frame, explaining the positional relationship between the latch plate and frame.
Figure 11B:
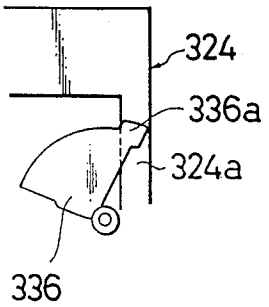

Referring also to FIG. 4, the latch plate 336 and frame 324 have such positional relationship that in the state of FIG. 11*a* in which the lock pin 337 is engaged in the lock lever groove 341*a*, the stop 336*a* is at a position remote from the frame engaging portion 324*a* while in the state in which the latch plate 336 is rotated through a maximum distance in the direction of arrow F in FIG. 10 after the cassette is inserted, the latch plate overlaps over the engaging portion 324*a* as shown in FIG. 11*b* to thereby prevent the removal of the feed cassette 300 out of the case 308.

Figure 12:
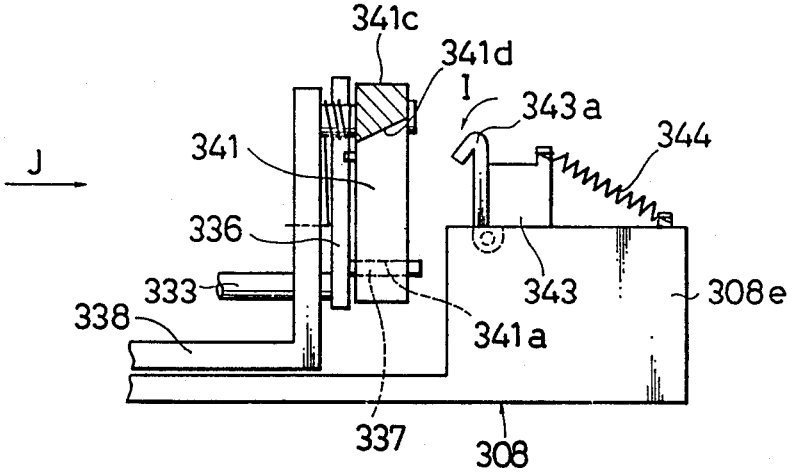
FIG. 12 is a view of the cassette lock mechanism as viewed in the direction of arrow H in FIG. 10.

FIG. 12 shows the lock lever 341 as viewed in the direction of H in FIG. 10. As seen in this Figure, the lock lever 341 has an end 341*c* which has a lower rightward rising inclined surface 341*d* on which a latch hook 343*a* of a latch pawl 343 is arranged to abut which is pivoted in the case pedestal 308*e* and turnable only in the direction of arrow I. The latch pawl 343 is urged so as to be turned in the reverse direction to the arrow I by a coil spring 344.

Figure 13:
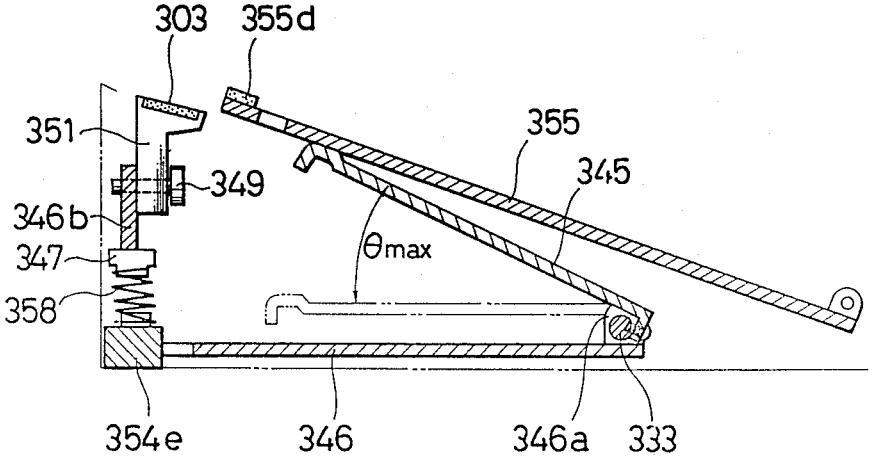
FIG. 13 is a cross section view of a pressure plate of the option tray and the associated elements.

A pressure plate 345 is fixed, for example, by screws substantially at the center of the shaft 333, as shown in FIG. 13 (also see FIG. 10). An L-like support plate 346 is provided such that its support 346*a* is rotatably supported onto the shaft 333 with the support plate 346 and pressure plate 345 in opposed relationship.

Attached substantially to the center of the width of the vertical wall 346*b* at the left-hand end of the support plate 346 is a pad holder 351 supported slightly rotatable by a pin 349 relative to the vertical wall 346*b* and urged upwardly by a coil spring 358 received between a cassette case side receiving seat 354*e* and a spring receiving seat 347 on the vertical wall 346*b* side.

The friction pad 303 is made of a material having a large coefficient of friction, for example, of cork and fixed integrally to the upper surface of pad holder 351 with an adhesive.

The maximum turned angle $\theta_{MAX}$ of the pressure plate 345 is determined by a position where an upper end of the operation knob 334*b* of the release lever 334 abuts on an end of a lever opening 330 in the front wall 354*a* and the pressure plate 345 is limited so as not to rotate beyond a required range.

Figure 14A:
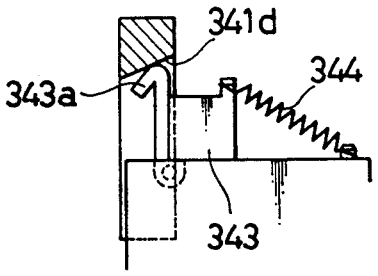
FIGS. 14*a* to 14*c* illustrate different stages of engagement of a lock lever and a latch pawl.

When the paper feed cassette 300 is inserted in the direction of arrow J in FIG. 12 into the case 308 in a state in which the lock pin 337 is engaged in the groove 341*a* in the lock lever 341 by pushing down the release lever 334 in the direction reverse to the arrow F of FIG. 10, the inclined surface 341*d* of the lock lever 341 abuts on the latch pawl hook 343*a* as shown in FIG. 14*a* and the lock lever 341 is turned slightly against the action of the spring 342 in the direction reverse to the arrow G in FIG. 10, so that the lock pin 337 slips off from the groove 341*a*. Thus the latch plate 336 is rotated by the force of the coil spring 335 via the shaft 333 from the state of FIG. 11*a* to the state of FIG. 11*b* in which the stop 336*a* enters the mating portion 324*a* of the frame 324 and laps over the frame 324. Under such condition, the feed cassette 300 cannot be removed from the case 308 because the latch plate 336 is locked.

At this time, the pressure plate 345 is turned via the shaft 333 in accordance with rotation of the latch plate 336, so that the bottom plate 355 is lifted as shown in FIG. 13, and the sheets of paper 301 placed on bottom plate 355 are pressed at their uppermost one by the feed roller 302, as shown in FIG. 2.

Figure 14B:
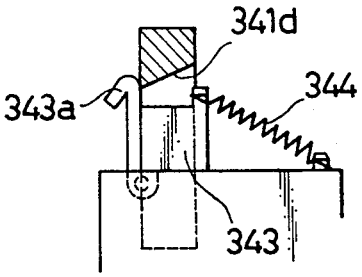

When the feed cassette 300 is inserted into a predetermined position, the lock lever 341 rides over the latch pawl 343 and is engaged firmly, as shown in FIG. 14*b*.

Figure 14C:
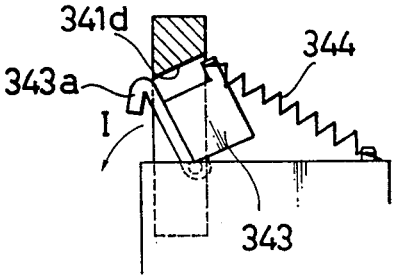

When the feed cassette 300 is to be removed, the release lever 334 is pushed down in the direction reverse to the arrow F in FIG. 10. The lock pin 337 of the latch plate 336 is then slid on the guide surface 341*b* of the lock lever 341 to fit into the groove 341*a*. Thus the latch plate 336 returns to the state of FIG. 11*a*, so that the cassette is unlocked and the latch pawl 343 is turned in the direction of I, as shown in FIG. 14*c*, thereby allowing the removal of the cassette 300.

A mechanism which senses the size of a cassette will now be described in detail with reference to FIGS. 15 and 16. The option tray 9 is usable to accommodate various sizes of sheets such as A-4, legal and letter sizes and one of cassette size subsensors 332A to 332C different in sensor shape and prepared for the respective sheet sizes as shown in FIG. 15 is used in accordance with the size of a respective one of the sheet sizes.

A typical subsensor 332A will now be described. For example, the subsensor 332A includes a U-like body of a thin steel material (magnetic material), one branch of the U including a size sensing tongue 332*a* integral therewith and having a width narrower than the base 332*b*. Both the end portions of the base 332 function as inserts 332*c* and 332*d*. The other branch of the U, designated 332*e*, has the same width as the base 332*b* and functions to prevent reverse insertion of the subsensor 332A. The other branch 332*e* is formed to be shorter than the branch or tongue 332*a*.

Figure 15:
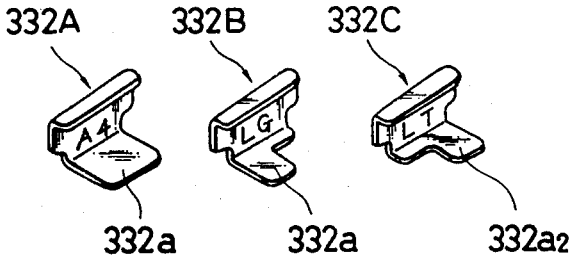
FIG. 15 is a perspective view of different cassette size sensing elements.

As shown in FIG. 15, the size subsensor 332A is for an A-4 size and the sensing tongue 332*a*. thereof is for an A-4 size and the maximum in width among those of all the subsensors. The width of the sensing tongue of a subsensor 332B for a legal size is half of that of the A-4 subsensor 332 A and deviates leftward in the subsensor body. The width of the sensing tongue 332*a* of a subsensor 332C for a letter size also is half of that of the subsensor 332A and deviates rightward in the subsensor body.

A groove 354*d* in the cassette case 354 into which the subsensor 332 (which generally represents the subsensors 332A to 332C) is inserted has a rubber magnet tape 359 having an elasticity bonded therein with a bond.

Figure 16A:
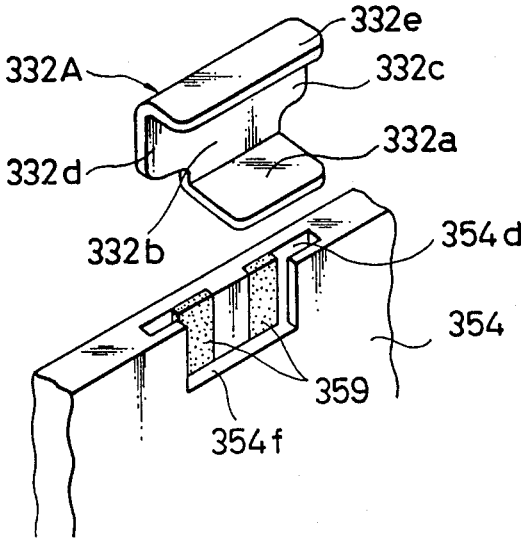
FIG. 16*a* is a perspective view of the cassette size sensing element illustrating a state in which the sensing element is inserted into the cassette.

In order to mount the subsensor 332 in the cassette case 354, the subsensor 332 is inserted into the cassette case with its tongue 332*a* below the base 332*b*, as shown in FIG. 16. Then the inserts 332*c* and 332*d* of the base 332*b* are inserted into a groove 354*d* formed in the cassette case 354 and the subsensor is pushed strongly against cassette case. Thus the subsensor is lowered until the sensing tongue 332*a* abuts on the groove bottom 354*f*, and is positioned.

The inserted subsensor 332 is drawn at the back of the base 332*b* by the magnetic force of the magnet tape 359 and pushed closely against the cassette by the resiliency of the rubber magnet tape 359, so that the subsensor is reliably held without slipping off from the cassette case even when the cassette 300 is inserted and/or removed.

If the subsensor 332 should be wrongly intended to be inserted with its tongue 332*a* above the base, the insertion preventive arm 332*e* will hinder the insertion of the subsensor 332 into the groove 354*d*, so that wrong reverse insertion of the subsensor is reliably prevented.

The reverse insertion preventive arm 332*e* is not necessarily required to be formed throughout the overall length of that edge of the base, from which the sensing tongue of the subsensor does not extend. It is only required to be formed at at least positions on that base edge corresponding to the inserts 332*c* and 332*d*.

A rigid magnet may be attached to the groove wall through the medium of a resilient material instead of the rubber magnet tape.

If the feed cassette 300 is inserted to a predetermined position in the case 308 and set, the cassette size sensor 321 of FIG. 4 senses the shape of the subsensor tongue 332*a* in accordance with a combination of transmission and interruption of light influenced by the shape of the subsensor tongue 332*a* to thereby sense the cassette size (sheet size).

Figures 16B, 16C:
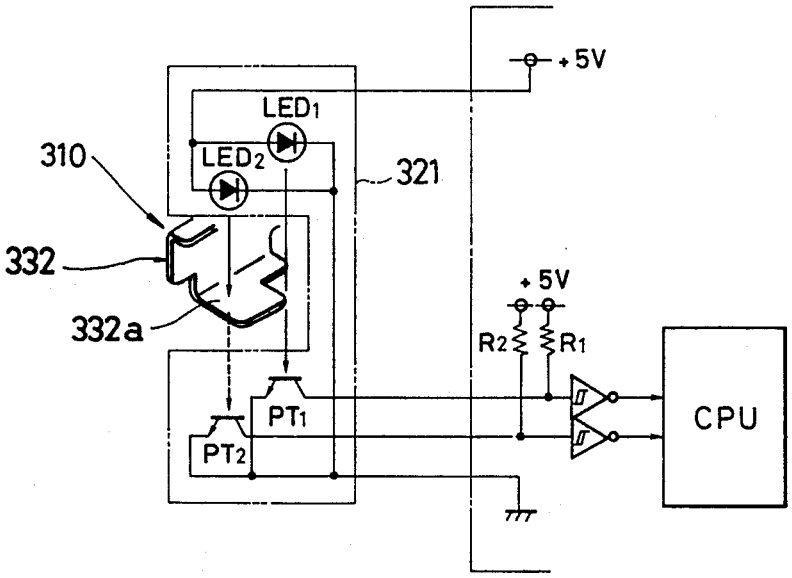
FIG. 16*b* illustratively shows a cassette size sensor and a circuit diagram of a sensed signal input unit in a control board.
FIG. 16*c* illustrates the relationship among a combination of sensed signals from the cassette size sensor, the presence/absence of a cassette, and the cassette size.

As shown in FIG. 16*b*, the cassette size sensor 321 may include, for example, two sets of photosensors, one set including a light emitting diode LEDl and a phototransistor $PT_1$, and the other set including a light emitting diode $LED_2$ and a phototransistor $PT_2$. The two sets of photosensors are disposed in opposing relationship so as to face the right-hand and left-hand sides of the subsensor tongue 332*a*.

The cassette size sensor 321 is connected to the control board 310, and the collectors of phototransistors $PT_1$, $PT_2$ are each impressed with a +5V voltage via pull-up registers $R_1$, $R_2$ with the emitters being grounded. The sensed signals $S_1$, $S_2$ on the collector side are input to a CPU of the control board 310 via trigger inverters.

Therefore, when the phototransistors $PT_1$, $PT_2$ are exposed to light from the light emitting diodes $LED_1$, $LED_2$, and turned on, the sensed signal $S_1$, $S_2$ become low (L) and when the light from the light emitting diodes $LED_1$, $LED_2$ is interrupted by the subsensor tongue 332*a* of the subsensor 332, the sensed signals $S_1$, $S_2$ become high (H).

The relationship among combinations of "L" and "H" of detected signals $S_1$, $S_2$, the presence/absence of a cassette and the size of the cassette is shown in FIG. 16*c* and judged by the CPU.

Figure 17:
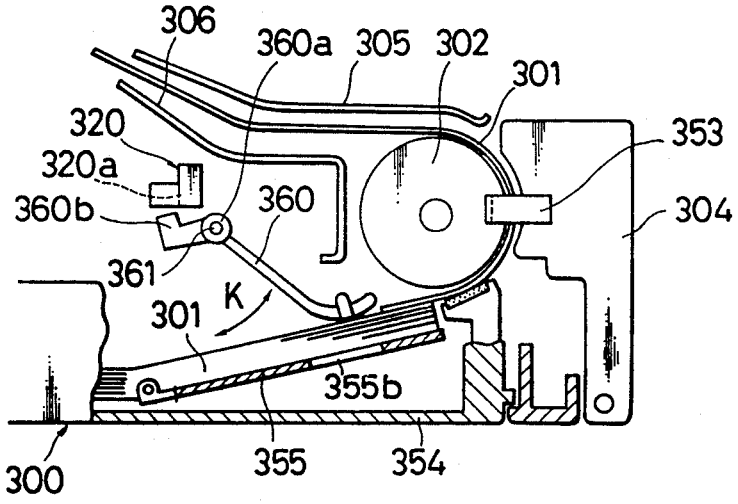
FIGS. 17 and 18 are a front view and a perspective view, respectively, of a paper end sensor and the associated elements, partially shown in cross section.

The detection of the paper end will now be described in detail with reference to FIGS. 17 and 18. Provided above the bottom plate 355 is a filler 360 supported at its support portion 360*a* so as to be turned around a pin 361 in the direction of arrow K in FIG. 17. The free end of the filler is arranged to fall by its own weight into a hole 355*b* in the bottom plate 355 when there are no sheets of paper 301 left on the bottom plate 355. An upward protrusion 360*b* formed at the rear end of the support portion 360*a* is arranged to enter a groove 320*a* in a paper end sensor 320 which includes a photosensor.

Figure 18:
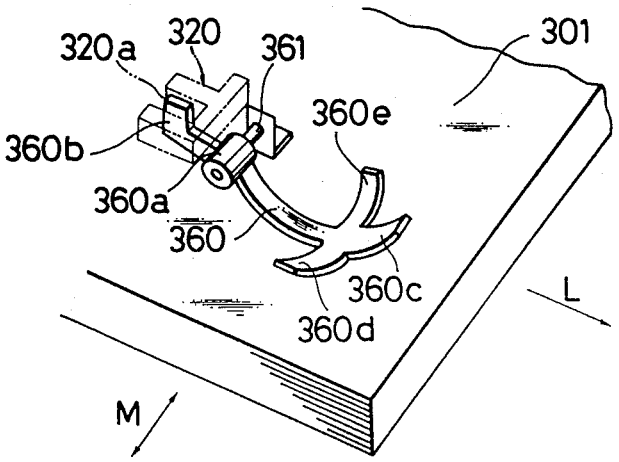

The filler 360 has at its free end upwardly curved or inclined branches 360*c* to 360*e* which extend in the direction of feed of a sheet paper 301 (arrow L) and in the opposite directions (arrow M) perpendicular to the direction L and in which the cassette 300 is inserted and/removed, as shown in FIG. 18. The height of the leading ends of the branches 360*c* to 360*e* in a free state is set so as to be higher than the position of the upper surface of the bottom plate 355 which is raised to its highest position (when the pressure plate 345 is rotated through its maximum angle $\theta$max); namely, substantially the same position as the upper surface of the fully stacked sheets of paper on the lowered bottom plate.

Therefore, even if the feed cassette 300 is inserted into the case 308 under a condition in which the bottom plate 355 is wrongly raised or under a condition in which the bottom plate is lowered with full sheets loaded on the bottom plate, the filler 360 is raised with its branches 360*d* contacting the bottom plate 355 or the upper surface of the stacked sheets, so that the branches 360*d* will not be broken.

When a sheet 301 is present on the bottom plate 355, the filler 360 is raised, so that the protrusion 360*b* of the rear end of the filler is positioned out of the groove 320*a* in the paper end sensor 320 and the sensor transmits light therethrough. Thus the sheet of paper 301 is put in the fed state. When the sheets of paper are used up, the free end of the filler 360 falls and the protrusion 360*b* is inserted into the groove 320*a* to thereby interrupt light, so that the feed of a sheet of paper stops.

Figure 19:
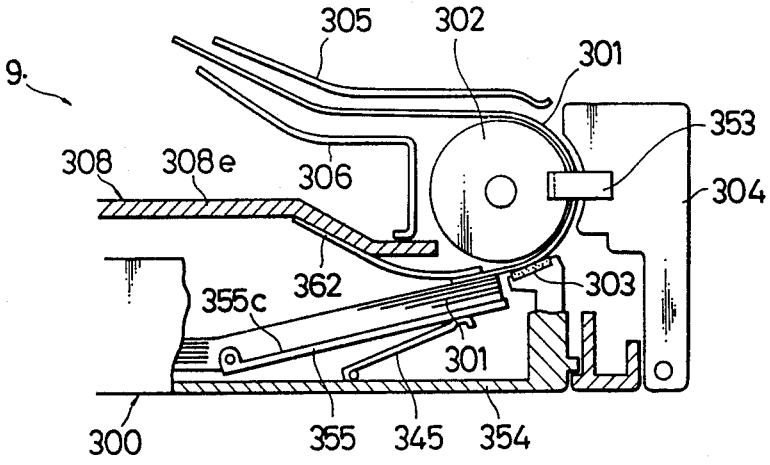
FIGS. 19 and 20 are cross section view of a paper curl restriction member and associated elements, and a perspective view of the paper curl restriction member having forward inclined corners, respectively.

FIG. 19 is a cross section view of a paper curl restricting member of the option tray and related parts thereof. The thin plate-like paper curl restricting member 362 made, for example, of a resilient material such as Mylar (trade name) is fixed to an upper surface 308*e* of the case 308 in the vicinity of the feed roller 302 of the option tray 9 such that when the bottom plate 355 is raised in use, the restriction member 362 is lightly pressed arcuately bent against the upper surface 355*c* of the bottom plate due to its resiliency.

Figure 20:
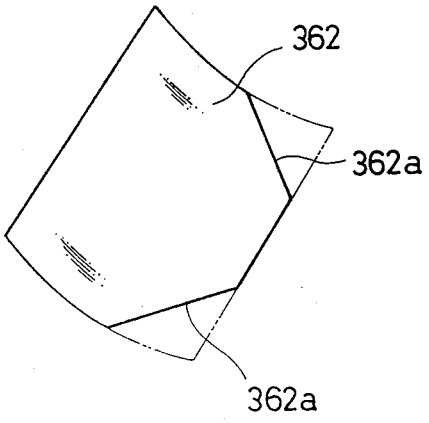

In order to prevent the breakage of the restriction member 362 itself and a shift of the uppermost sheet of paper when the cassette 300 is inserted or removed, the restriction member 362 has forward inclined corners 362*a* as shown in FIG. 20 and restricts its firmness to a minimum required for suppressing a curl of a sheet of paper.

Therefore, in the option tray 9, under a condition in which, for example, sheets of paper 301 are fully stacked on the cassette 300, and even if the sheets of paper are curled on both sides the uppermost sheet restricts the curl of the sheets of paper using the curl restriction member 362 with an extent of firmness which does not influence the feeding of a sheet of paper by the roller 302. Thus the curled sheet of paper is prevented from contacting the feed roller and separated upwardly or jamming and skew of a sheet of paper caused by a curl of the sheet of paper during conveyance are prevented.

Figure 21:
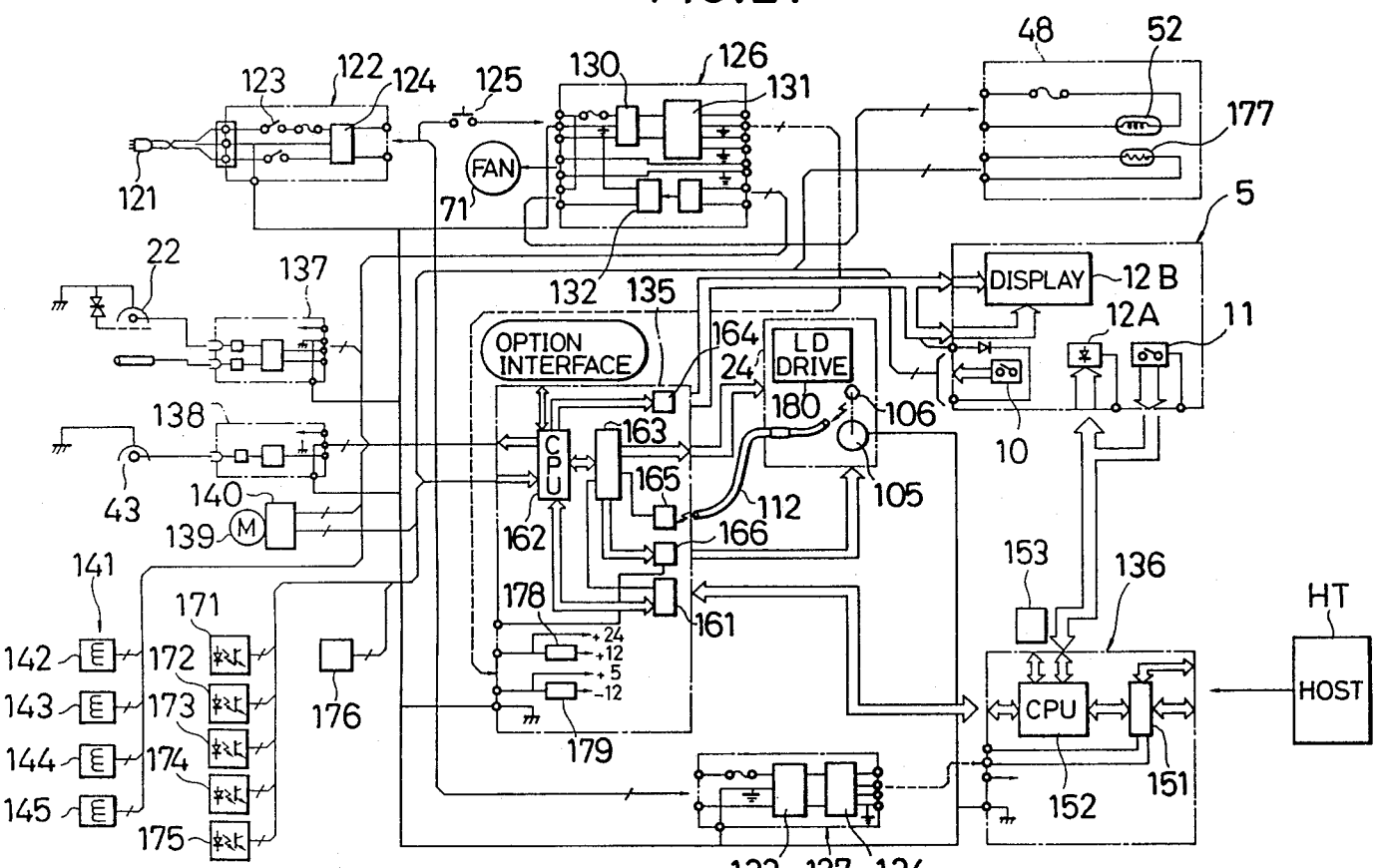
FIG. 21 is a schematic block diagram of an electric system in the apparatus proper of the embodiment.

FIG. 21 is a block diagram of the schematic structure of an electric system used in the laser printer proper. In the electric system, a source voltage is input from a commercial power source to a power source input 122 via a receptacle in which an AC plug 121 or an AC cable 317 of the option tray 9 is received.

The power source input unit 122 eliminates noise in the input voltage using a noise filter 124 after a main switch 123. The source input unit 122 supplies the filtered voltage to a main controller power source unit 126 via an interlock switch 125 to cut off the main power source when the upper unit 1 is separated from the lower unit 2 and raised, and also supplies the filtered voltage directly to a character controller power source unit 127.

The power source unit 126 includes a noise filter 130, a constant voltage circuit 131 which converts the input AC voltage to a DC voltage to produce a constant voltage, and a high-speed solid state relay (SSR) 132 which includes a switching element for on-off control of power supply to a heater 52 provided in the heating roller 50 of FIG. 2 in order to control the fixing temperature of the fixing unit 48.

The character controller power source unit 127 includes a noise filter 133 and a constant voltage circuit 134 which converts the input AC voltage to a DC voltage to produce a constant voltage.

The main controller power source unit 126 supplies a source voltage to a main controller 135 formed on the main control substrate 75 (FIG. 2); a charge and developing power pack 137 for the charger 22 and a developing bias; a transfer power pack 138 for a transfer charger 43, a main motor unit 140 including a driver for a main motor 139, a crystal oscillator for generating a reference signal for constant speed control, encoders, power circuits, a servo circuit, etc.; a group of various operating devices 141; the ozone fan 71 and a suction fan (not shown); the heater 52 of the fixing unit 48, etc.

The character controller power source unit 127 provides a power source voltage to a character controller 136 formed on the character controller substrate 76 (FIG. 2).

The group of various operating devices 141 includes a paper feed clutch 142 which controls the rotation of the feed roller 37 (FIG. 2), a paper convey clutch 143 which controls the rotation of the lower conveyor roller 40, a total counter solenoid 144 which causes a total counter which indicates the number of prints (not shown) to count up, and a latching solenoid 145 provided at the suction fan unit 72.

The control system will now be described. The character controller 136 includes an interface 151 for the host HT, and a microcomputer (hereinafter referred to as CPU) 152 including a MPU, a ROM, a RAM and an I/O. The interface 151 receives character information from the host HT and sends status information to the host HT. CPU 152 converts the character information, received from the host HT via the interface 151, into character font information using a font cartridge (or an internal font cartridge) 153 inserted into the font cartridge inlet 6, and transmits the resulting information to the main controller 135. The CPU 152 also receives indication data from the respective switches of the switch group 11 on the operation panel 5 (FIG. 1) and controls the lighting of the displays 12A constituting the display group 12.

The main controller 135 includes a video interface 161 for the character controller 136; a microcomputer (hereinafter referred to as CPU) 162 including a MPU, a ROM, a RAM and an I/O; a write control unit 163; a display driver 164; a synchronism sensor 165; and a polygon mirror motor driver 166.

The video interface 161 transmits/receives character font information to/from the character controller 136 and transmits a clock signal, which is a control standard, to the character controller 136.

In the CPU 162, a built-in clock oscillator generates a clock signal. A built-in timer which operates in accordance with an internal clock signal from the clock oscillator is used to control timings for image formation processes such as charging, exposure, development, transfer, paper feed, and fixing.

The CPU 162 sends to a write control unit 163 written data corresponding to character font information received from the character controller 136 in accordance with an image clock (pixel clock) from the write control unit 163 in order to perform image recording.

The CPU 162 controls the lighting of the respective displays l2B which constitute the display group 12 provided on the control panel 5 and receives size selective data from the paper size selective switch 10 via the display driver 164.

The CPU 162 also controls the charge and developing power pack 137, transfer power pack 138, main motor driver 140, group of operating devices 141 and fixing control SSR 132. The CPU 162 also receives various sensed data from a resist sensor 171 including various transmission type photosensors, a sheet discharge sensor 172, a toner over sensor 173, a paper end sensor 174, latch sensor 175, a toner end sensor 176 including a microswitch, and a fixing temperature sensor 177 including a thermistor.

The respective positions where the sensors are mounted are shown in FIG. 2. While the toner end sensor 176 is not shown FIG. 2, it is disposed in the toner container 28 of the developing unit 26 in order to detect the absence of toner.

The write control unit 163 will now be described. The laser diode of the laser write unit 24 is driven by an LD driver 180 on the basis of written data from the CPU 162 to emit a laser beam corresponding to the written data. A drive start timing for the laser diode of the laser write unit 24 is controlled in accordance with a synchronism sensing signal output from the synchronism sensor 165 on the basis of a laser beam entered via an optical fiber 112 from the laser write unit 24.

The polygon mirror motor 105 of the laser write unit 24 is controlled via a polygon mirror motor driver 166, namely, the rotation of the polygon mirror 106 is controlled.

Provided within the main controller 135 are two voltage converters 178 and 179, each of which includes a three-terminal regulator and a DC/DC converter. These converters 178 and 179 generate various voltages.

Figure 22:
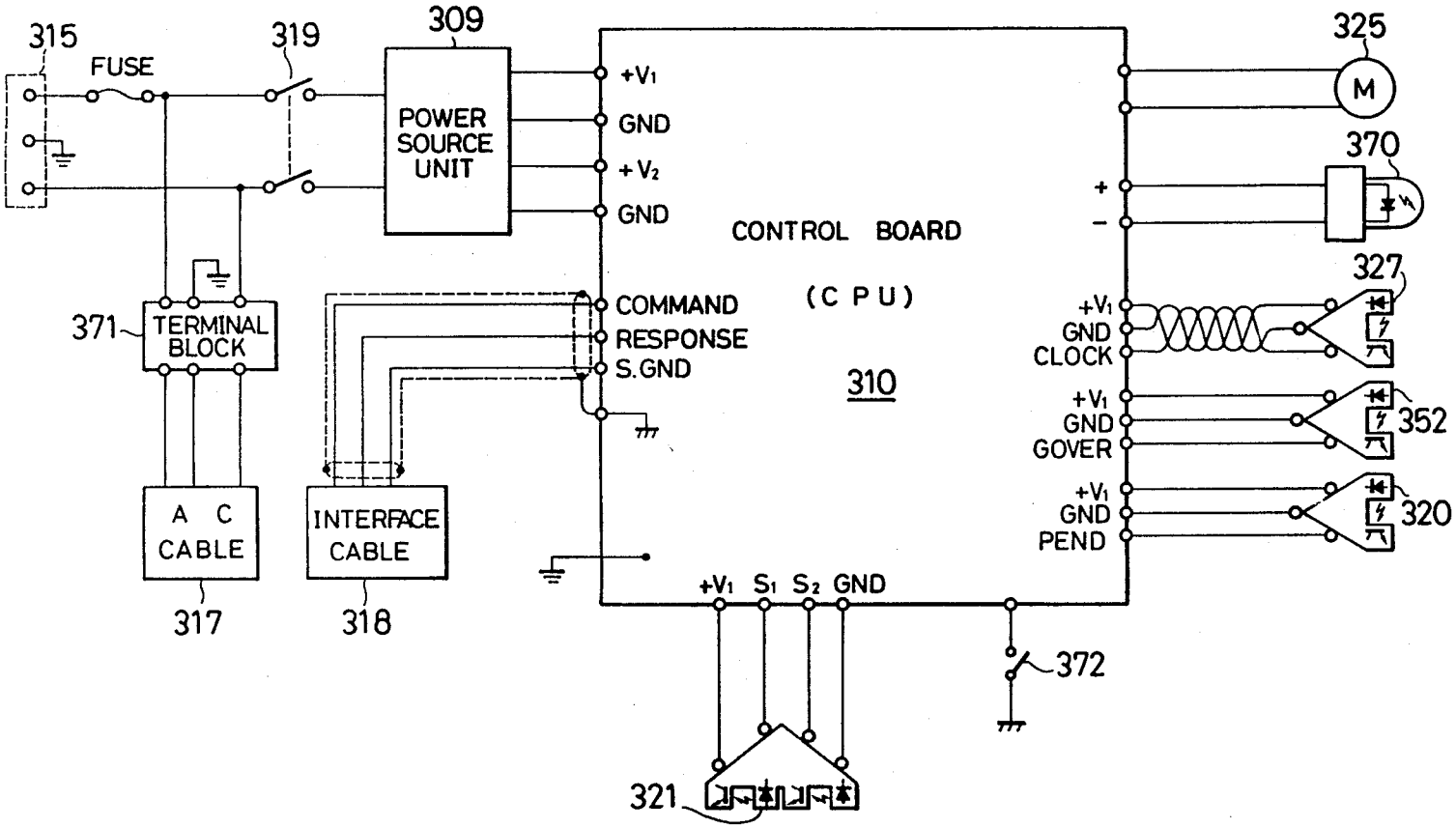
FIG. 22 is a schematic block diagram of the electrical system of the option tray.
Figure 23A:
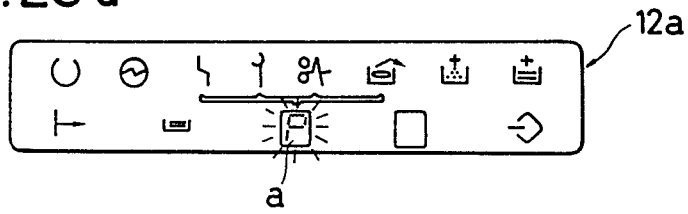
FIGS. 23*a* to 23*c* illustrate different error displays at an error display unit of the printer proper when some problem occurs in the option tray.
Figure 23B:
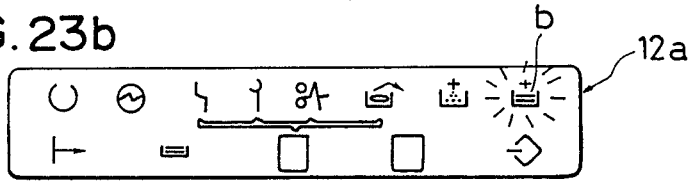
Figure 23C:
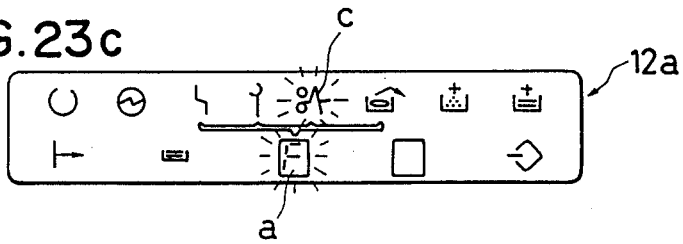
Figure 23D:
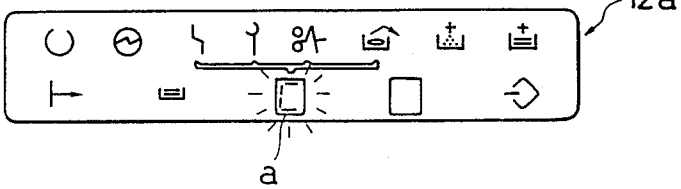
Figure 23E:
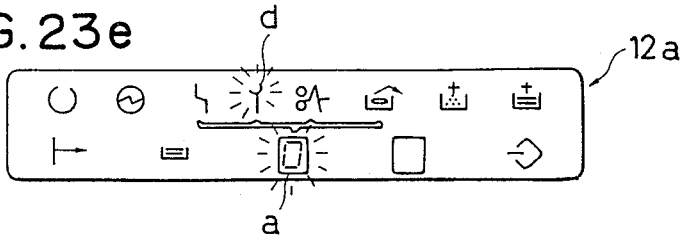

FIG. 22 schematically illustrates the electric system of the option tray 9 in the laser printer. If the power source cord plug from the commercial power source is inserted into an AC input receptacle 315, power is supplied to the power source unit 309 via a fuse and a power switch 319. The power source also branches to a terminal block 371 before the power switch 319 and supplies power via an AC cable 317 to the printer proper from the option tray by inserting the cable 317 plug into an AC input receptacle in the printer proper.

By such arrangement, an expensive 3-pin AC power source outlet following a safety standard is not needed in the printer proper and the cost is reduced.

The power source unit 309 drops the input AC 100 V via a transformer, rectifies, and smoothes the dropped voltage and supplies two different DC voltages $+V_1$ (for example, +5 V) and $+V_2$ (for example, +15 V) to a control board 310.

The control board 310 includes a microcomputer (CPU), an input/output interface, a feed motor driver, and a communication buffer. The control board 310 is also connected to the feed motor 325; a power indicator lamp 370; various sensors including paper end sensor 320, cassette size sensor 321, a cover sensor 352, a pulse sensor 327; and a self-test dip switch 372.

The control board 310 is also connected to an interface cable 318. When a plug at an end of the cable 318 is inserted into a receptable in the printer proper, the control board 310 is connected to the main controller 135 in the printer proper such that the CPU 162 and the CPU in the control board 130 can perform serial communication via an option interface for the main controller 135. The main controller 135 in the printer proper initiates the communication by transmitting commands to and requiring a response from the control board 310 on the option tray 9 side.

Each command is made of one byte. Among these commands are commands to start and stop the feed of a sheet of paper, a command which reports the non-selective or selective state of the option tray, and a command to require information on the state of the option tray 9 (transmitted at intervals of 1 second).

The response state from the option tray side is also made of one byte. These states include "being ready" (whether paper feed is possible), "hardware error" (errors in the CPU, etc.), "motor error" (troubles in the feed motor 325), "cover open" (the open or closed state of the turn cover 304), and data on the sheets of paper (paper size and paper end). These information items are transmitted by the respective bits of one byte (paper information alone is transmitted using two bits).

These data items are used by the main controller 135 of the printer proper and error information is displayed by the display 12 on the operation panel 5 of FIG. 1.

The control board 310 of FIG. 22 drives and stops the feed motor 325 in accordance with commands indicative of the start and stop of the paper feed from the printer proper. The control board 310 also counts clock pulses from a pulse sensor 327 to confirm the number of rotations of the feed motor 325 to thereby control the stop timing.

The pulse sensor 327 outputs a pulse signal from its phototransistor by interrupting the light beam from an LED of the photosensor due to the rotation of a slitted disc attached to the shaft of the feed motor 325.

The feed motor 325 rotates the feed roller 302 to feed out sheets of paper in the cassette 300 one by one, stops the feed motor 325 when the leading end of the fed-out sheet has contacted the rollers 39, 40 of FIG. 2 to thereby free the feed roller 302 to thereby allow the rollers 39 and 40 to convey the sheet with a predetermined timing.

When the paper end sensor 320 senses the paper end, the last sheet of paper is fed out. Therefore, that sheet of paper is stopped and held between the feed roller 302 and friction pad 303 and also directly held between the feed roller 302 and the friction pad 355*d* provided at the central front edge of the bottom plate 355 shown in FIG. 9 and 13. Thus a great frictional force acts on the sheet of paper, so that the sheet of paper cannot immediately be conveyed even if the rollers 39 and 40 are started and non-smooth movement occurs to thereby shift the transferred image partially.

In order to cope with this situation, when the paper end sensor 320 senses the paper end, the feed roller 302 is rotated through a predetermined angle, an additional predetermined rotation is applied to the feed roller 302 so as to feed the last sheet of paper to a where it leaves at least the friction pad 355*d*. Then the feed roller is stopped.

When an illuminated button switch 12*a* (see FIG. 1) for selection of the option tray and provided on the control panel 5 of the laser printer is pushed to select the option tray 9, the switch 12 is lit to indicate that fact. If the option tray is not connected, there is no response of the control board 310 of the option tray 9 to the command from the main controller 135 of the printer proper, so that the main controller 135 puts out the switch 12*a* and reports that the option tray is not selected.

If some problem occurs with the option tray under a state in which the option tray 9 is selected, the main controller 135 of the printer proper recognizes that fact by a response from the control board 310 of the option tray 9 and selectively displays the error contents as shown in FIGS. 23(*a*) to (*e*) at an error display 12*a* of the display 12 provided at the operation panel 5 (see FIG. 1) of the printer proper.

FIG. 23(*a*) shows the displays of paper size error. If the size of a sheet of paper sensed by the cassette size sensor 321 differs from that of a sheet of paper actually fed, the paper size selective switch 10 (FIG. 1) is disabled and a digital display a of the error display 12*a* turns on and off the display of the character "P".

FIG. 23(*b*) shows the display of paper supplementation request. When the paper end sensor 320 senses the feeding out of the last sheet of paper, the display of a paper supplement pattern b is turned on and off.

FIG. 23(*c*) shows the display of paper jamming. When paper jamming occurs, the display of a jam display pattern c is turned on and off and also the digital display a turns on and off the display of the character "F".

FIG. 23(*d*) shows the display of the cover being open. If the turn cover 304 is open, the digital display a turns on and off the display of the character "C" and stops the operation of the option tray.

FIG. 23(*e*) shows the display of a hardware error. If an error occurs in the control board 310 or in the feed motor 325, the display of a serviceman call pattern d is turned on and off and the digital display a displays the character "O".

The control board 310 of FIG. 22 controls the drive of the feed motor 325 in accordance with commands indicative of the start and stop of paper feed from the printer proper. The control board 310 also counts pulses (clock pulses) from the pulse sensor 327 to ascertain the number of rotations of the feed motor 325 to thereby control the stop timing.

The pulse sensor 327 outputs a pulse signal from its phototransistor by intermittently interrupting the light from the LED of the photosensor due to the rotation of the slitted disc attached to the shaft of the feed motor 325.

The operation of the paper feed unit of the option tray 9 will now be described in detail with reference to FIG. 24. When the feed cassette 300 in which many sheets of paper 301 are stacked is mounted in the case 308 of the option tray 9, the bottom plate 355 is raised by the pusher plate 345, as shown in FIG. 13, and pressed against the feed roller 302 via the friction pad 355*d* provided at the end of the pusher plate 345.

When the feed motor 325 rotates the feed roller 302 in the direction of the related arrow in accordance with a command from the printer proper, the uppermost sheet of paper 301 alone is taken out due to the differences in coefficient of friction between the feed roller 302 and sheet of paper 301, between sheets of paper 301, and between sheets of paper 301 and friction pad 355*d*. The taken-out sheet of paper is held between the feed roller 302 and the friction pad 303 attached to the pad holder 351 to thereby prevent reliably double sheets of paper from being fed using the frictional force between the roller 302 and holder 351, i.e., thereby feeding out a single sheet of paper alone within the turn cover 304 along the conveyor passageway formed between the upper guide plate 305 and paper guide 306 to the predetermined position where the sheet of paper contacts the conveyor rollers (resist rollers) 39 and 40.

When the leading end of the sheet of paper 301*a* comes close to the conveyor rollers 39, 40, the resist sensor 171 senses the leading end of the sheet of paper and sends the sensed signal to the main controller 135 which thereby sends a feed motor stop command to the control board 310. In response to the stop command, the control board 310 counts a predetermined number of (N) pulse signals from the pulse sensor 327 to thereby stop the feed motor 325.

At that time, the sheet of paper 301*a* is fed such that the leading end of the sheet of paper is fed slightly ahead of the forward end of the conveyor passageway to thereby cause the leading end of the sheet of paper 301*a* to reliably stick out into the bite of conveyor rollers 39 and 40 to thereby cause a slight bending, as shown, to correct a skew in the sheet of paper.

Since the feed path from the option tray 9 is longer than the feed path from the feed tray 13 of the printer proper, the rotational speed of the feed roller 302 in the option tray 9 is set so as to be greater than that of the feed roller 37 of the printer proper such that the time taken from the start of paper feeding to the detection of the leading end of the sheet of paper by the resist roller 171 is the same with those different feed paths.

Thereafter, the conveyor rollers 39 and 40 are started with a predetermined timing to feed the delivered sheet of paper 301*a* to the transfer unit. At this time, the rear end of the sheet of paper 301*a* is still held between the feed roller 302 and friction pads 355*d*, 303. The feed roller 302 has a one-way clutch intervening in its shaft, so that even if the shaft stops, the feed roller 302 can rotate freely in the direction of paper feeding, and the sheet of paper 301*a* can be drawn out and conveyed by the rollers 39 and 40.

Figure 26:
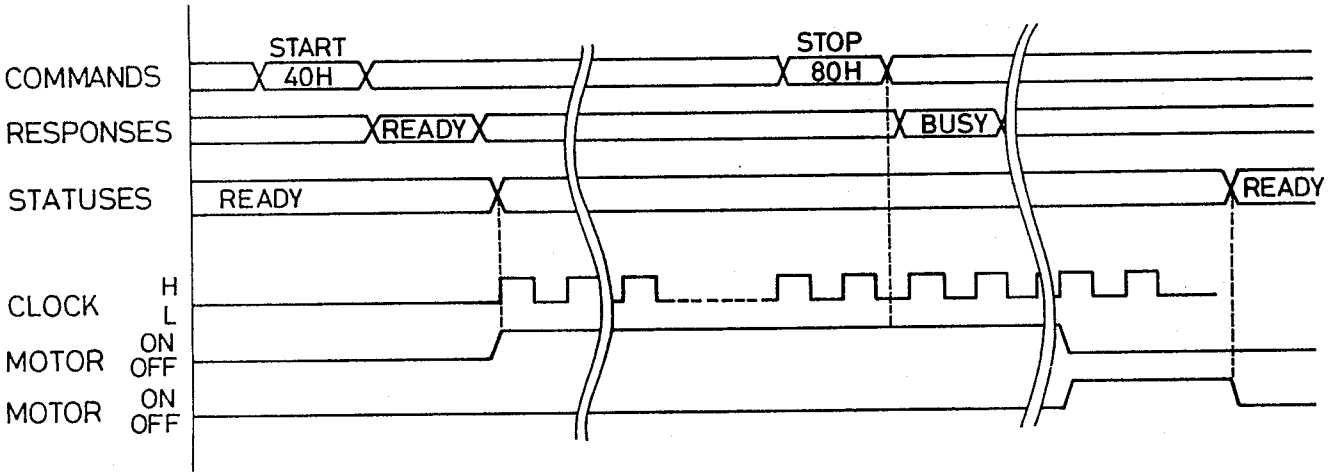
FIG. 26 is a timing chart for a standard operation of the option tray with commands from the apparatus proper in the particular embodiment.

FIG. 26 shows commands from the printer proper and a timing chart for a standard operation of the option tray effected when two or more sheets of paper are stacked in the cassette 300.

In this particular embodiment, when the feed motor 325 is stopped, it is reversed for a short time to disengage the one-way clutch of the feed roller 302 to prevent a coasting rotation of the feed roller 302.

Figure 25:
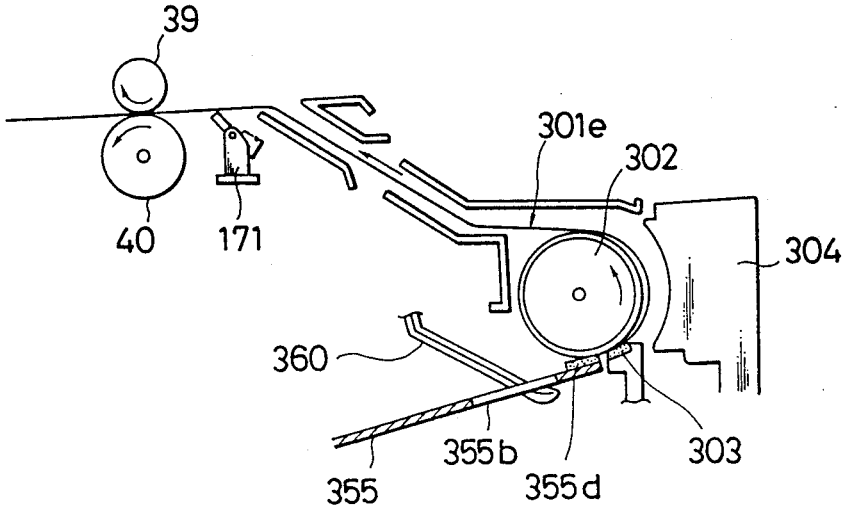
FIG. 25 is a view, similar to FIG. 24, when the last sheet of paper is fed.

As shown in FIG. 25, when the last sheet of paper 301*e* in the cassette 300 is to be fed, it is directly pushed against the feed roller 302 by the friction pad 355*d* on the bottom plate 355.

By the rotation of feed roller 302 in the direction of the related arrow, the last sheet of paper 301*e* is fed to the predetermined position as in the previous case, and the feed roller 302 is stopped. Thereafter, a load on the conveyance of the last sheet of paper 301*e* using the rollers 39 and 40 increases. Especially when the rear end of the sheet of paper 301*e* reaches the friction pad 355*d*, the friction pad 355*d* directly contacts the feed roller 302. A braking action on the free rotation of the feed roller 302 increases in the direction of the related arrow. Furthermore, when the rear end of the sheet of paper 301*e* starts to move between the feed roller 302 and another friction pad 303, the feed roller 302 and friction pad 303 start to contact each other directly, so that the load on the drawing out of the sheet of paper 301*e* becomes maximum.

Therefore, if the conveyance power of the conveyor rollers 39 and 40 is not large compared to the load, the sheet of paper 301*e* is not conveyed, knocking may occur to hinder smooth conveyance, and partial image shifts or torsions may occur in the reproduced image. Especially if paper powder deposits on the rollers 39 and 40, the sheet of paper will easily slide and the conveyance force is reduced, so that those problems are likely to occur.

In order to solve those problems in the particular embodiment, the delivery of the last sheet of paper 301*e* is arranged to be sensed by the fall of the free end of the filler 360 of the paper end sensor 320 into the hole 355*b* in the bottom plate 355, as shown in FIG. 25. When the sensed signal is input to the control board 310 from the paper end sensor 320, the last sheet of paper 301 is delivered to the predetermined position as in the above normal case, the rotation of the feed roller 302 by the feed motor 325 is stopped. Then the feed roller 302 is additionally driven by a set time or by a set angle of rotation such that the rear end of the sheet of paper is smoothly removed out from the bite of the feed roller 302 and friction pads 355*d*, 303 during conveyance of the last sheet of paper 301 by the conveyor rollers 39 and 40.

Figure 27:
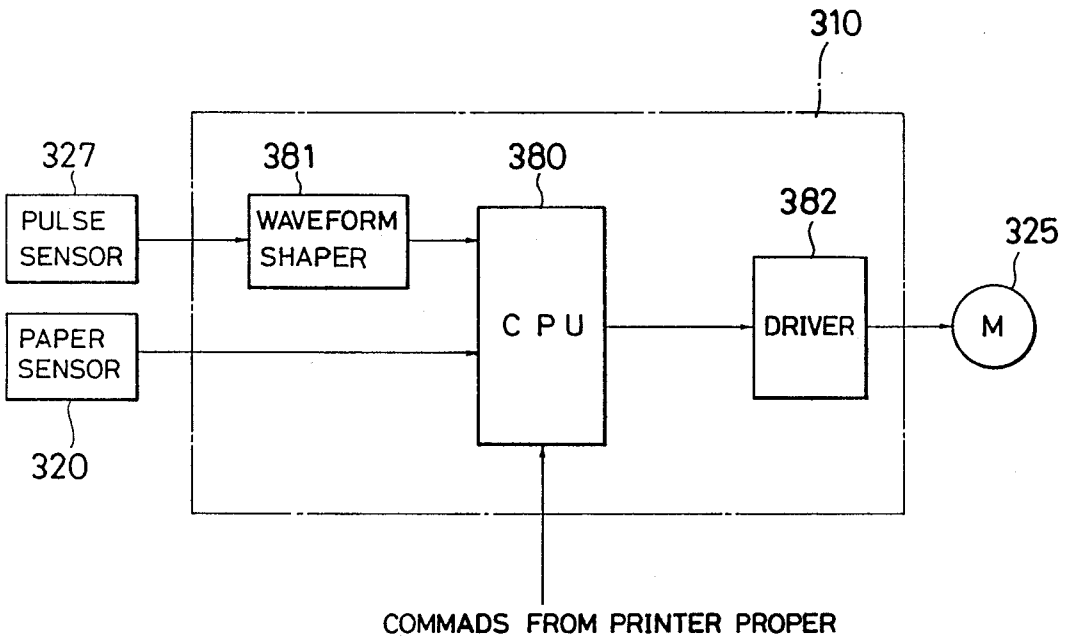
FIG. 27 is a block diagram for realizing the paper feed control in the embodiment using a CPU in the control board.

FIG. 27 shows the hardware structure which controls the feeding of a sheet of paper using the microcomputer (CPU) in the control board 310. The processing operation by the hardware will now be described with reference to the flowchart of FIG. 28. In FIG. 27, reference numeral 380 denote a CPU including a paper feed timer, a last-paper motor on timer, a last-paper motor off counter and a last-paper detection flag memory, which will be described later in more detail. Reference numerals 381 denote a waveform shaper which shapes the waveform of a pulse signal generated from the pulse sensor 327 each time the feed motor 325 rotates through a predetermined angle and which outputs the resulting signal to the CPU 380. A driver circuit 382 drives the feed motor 325 in accordance with a signal from the CPU 380.

Figure 28A:
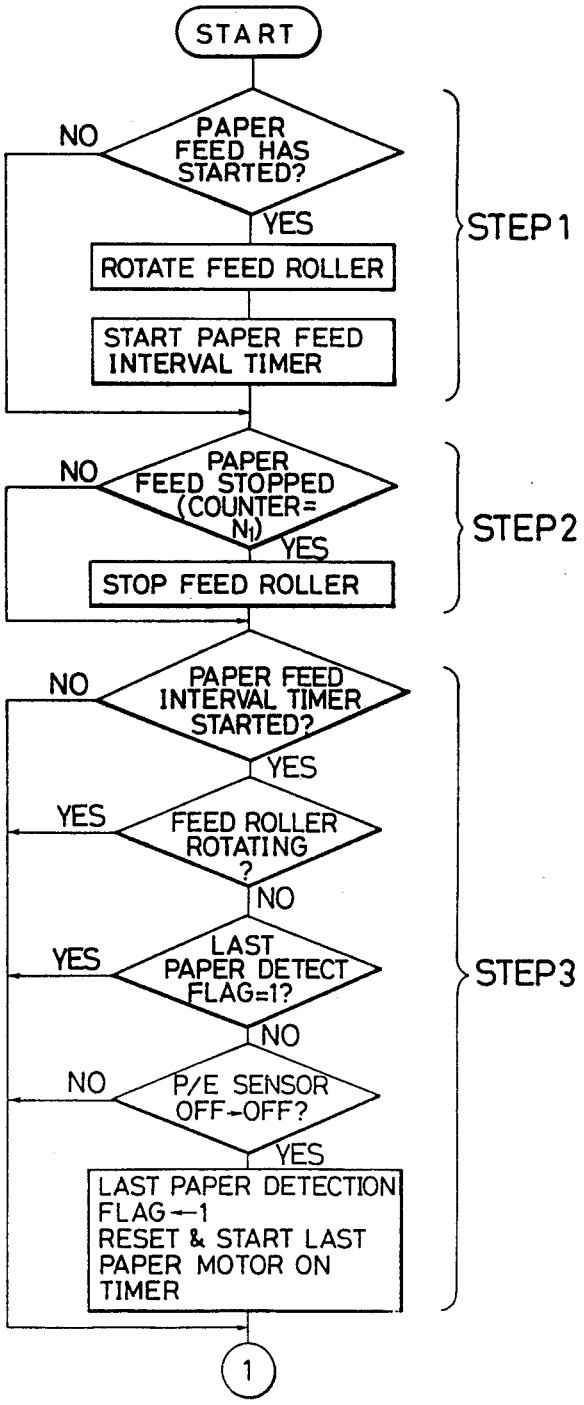
FIG. 28 is a flowchart showing the processing steps in the paper feed control.
Figure 28B:
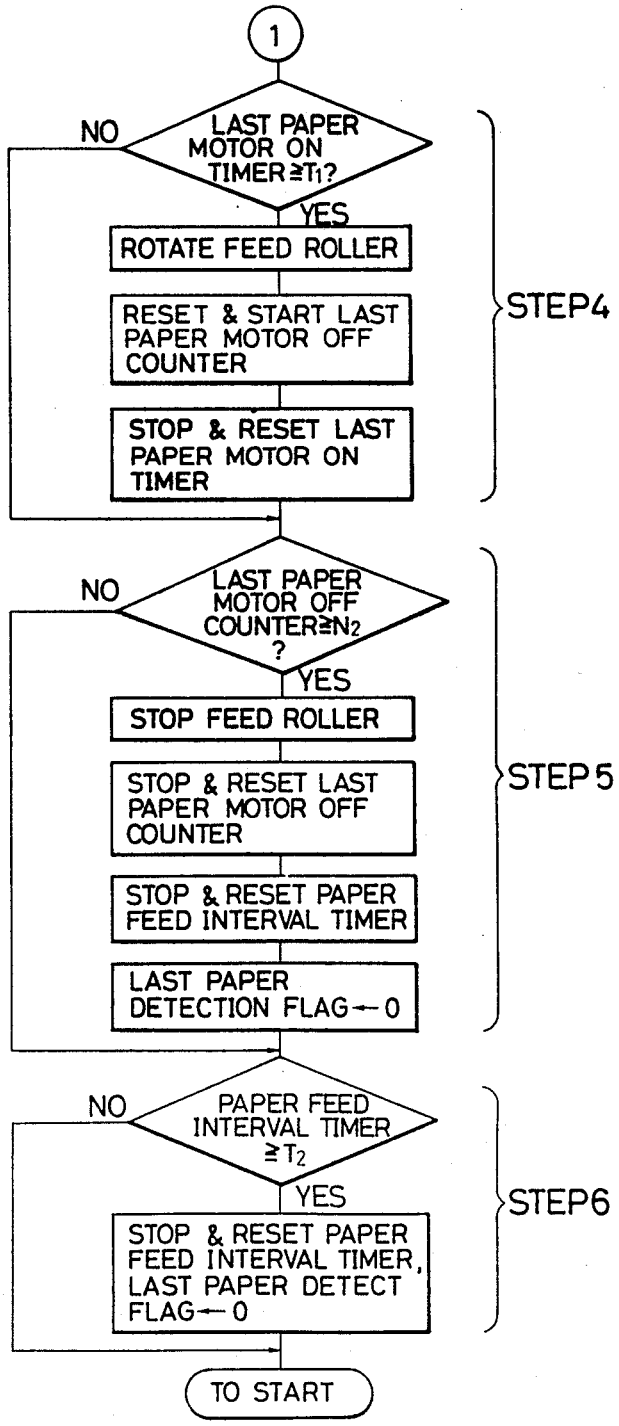

When paper feeding starts in accordance with a start command from the printer proper at step 1 of FIG. 28, the CPU 380 turns on the feed motor 325 to rotate the feed roller 302 to thereby feed a sheet of paper and, at the same time, start the paper feed interval timer in the CPU 380. The paper feed interval timer operates only for the time $T_2$ from the start of paper feeding to the time when the rear end of the sheet of paper passes the position of the filler 360 of the paper end sensor 320.

When the leading of the delivered sheet of paper turns on the resist sensor 171, pulse signals from the pulse sensor 327 start to be counted in response to a stop command from the printer proper. When the count reaches $N_1$ which indicates the number of pulses generated from the time when the leading end of the sheet of paper is sensed by the resist sensor 171 to the time the leading end of the sheet of paper abuts on the conveyor roller 39 and 40, the feeding of a sheet of paper is stopped and the feed motor 325 is turned off to thereby stop the feed roller 302 at step 2.

At step 3 it is determined whether the paper feed timer has started. If not, the procedure shifts to 1. If the timer has started, it is determined whether the feed roller is rotating and whether the last-paper detection flag is "1". If the answer is yes at either of these substeps, the procedure shifts to 1. If not, it is determined whether the paper end sensor 320 is changed from off to on. If not, procedure shifts to 1 while if yes, the last-paper detection flag is changed to "1" an the last-paper motor on timer is reset and started.

Therefore, when the last-sheet of paper in the paper cassette is fed out and the feed roller 302 is stopped, the above processing is performed because the paper end sensor 320 is changed from off to on. The last-paper motor on timer determines the timing with which the feed motor 325 is turned on after the paper end sensor 320 has started to operate.

At step 4 when the time $T_1$ of the last-paper motor on timer becomes the time taken from the time when the rear end of the last sheet of paper has actuated the paper end sensor 320 to the time when the rear end of the sheet of paper arrives at the friction pad 355*d*, the CPU 380 turns on the feed motor 325 to rotate the feed roller 302 in the direction of feed of a sheet of paper.

At this time, the last-paper motor off counter is reset and started to count pulse signals from the pulse sensor 327 to stop and reset the last-paper paper motor on timer.

Thereafter, the procedure shifts to step 5. When the count of the last-paper motor off counter reaches N larger than the number of pulses generated by the rotation of the feed motor 325 by the time when the rear end of the sheet of paper passes through the passageway between the feed roller 302 and friction pad 303 (for example, twice as large as the generated number of pulses), the feed motor 325 is turned off to thereby stop the feed roller 302, and the last-paper motor off counter and paper feed timer are stopped and reset, and the last paper detection flag is set to "0".

At step 6 it is determined whether the sheet of paper feed interval timer's time is greater than $T_2$. If so, the paper feed interval timer is stopped and reset and the last-paper detection flag is set to "0".

This is done so because the processing at steps 3, 4 and 5 is intended for only the time interval $T_2$ taken from the time when the sheet of paper has started to be fed to the time when the rear end of the sheet of paper passes through the filler 360 of the paper end sensor 320. If this should not be performed, the paper end sensor 320 would disadvantageously operate and the feed roller 302 would be rotated if the bottom plate 355 is lowered when no sheet of paper is fed.

As just described, by rotating the feed roller 302 again a time $T_1$ after the rear end of the last sheet of paper has actuated the paper end sensor 320 only when the last sheet of paper is fed, up to the last sheet of paper may be delivered normally even if the conveyance force of the rollers 39 and 40 is lowered.

Figure 29:
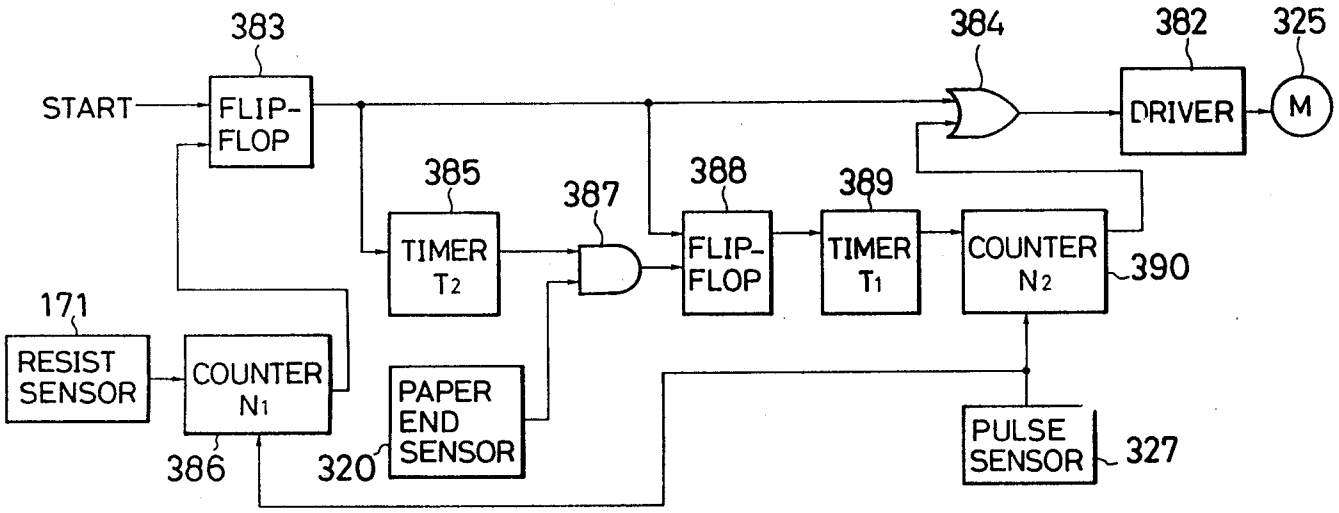
FIG. 29 is a block diagram of the paper feed control unit in another embodiment of this invention.
Figure 30:
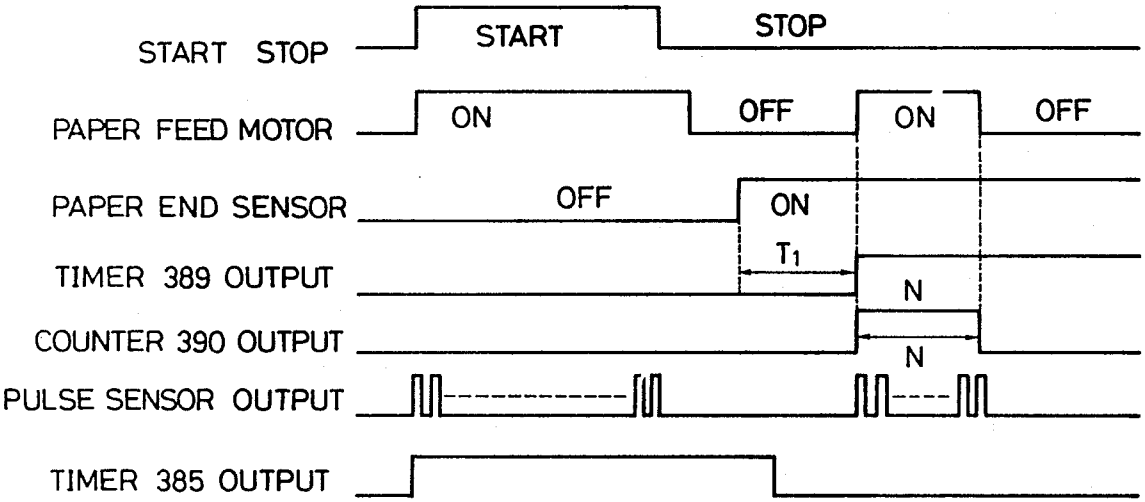
FIG. 30 is a timing chart explaining the operation of the paper feed control unit.

An embodiment of this invention which realizes the control of paper feeding, similar to those mentioned above, without using an microcomputer will now be described with reference to the block diagram of FIG. 29 and the timing chart of FIG. 30.

When paper feed start signal is input to a flip-flop 388, the flip-flop 38 outputs "1" which is input via an OR gate 384 to a driver 382 to thereby turn on the feed motor 325 and rotate same to feed a sheet of paper. Simultaneously, that signal starts a delay timer 385 to thereby reset a flip-flop 388.

The delay timer 385 outputs "1", delayed by a time taken from the time when the delivery of a sheet of paper has started to the time when the rear end of the sheet of paper passes through the filler 360 of the paper end sensor 320.

When the leading end of the delivered sheet of paper is sensed by the resist sensor 171, the sensed signal from the sensor 171 causes a counter 386 to start to count pulse signals from the pulse sensor 327.

Thereafter, when the count of the counter 386 reaches $N_1$ (the number of pulses generated from the time when the leading end of the sheet of paper is sensed by the resist sensor 171 to the time when the leading end of the sheet of paper abuts on the conveyor rollers 39 and 40), the output of the counter 386 output becomes "1" to reset the flip-flop 383 to cause same to output "0". Therefore, the output from the OR gate 384 also becomes "0", so that the driver 382 turns off the feed motor 325 to stop the rotation of the feed roller 302.

If the delivered sheet of paper is the last one in the feed cassette 300, the paper end sensor 320 operates and outputs "1" when the rear end of the sheet of paper passes through the filler 360. Since the output of the timer 385 is also "1" at this time, the output of an AND gate 387 also becomes "1" to set a flip-flop 388, the output of which becomes "1".

This causes the delay timer 389 to start to thereby start a counter 390 and thus changes its output to "1" after a delay time $T_1$ similar to that in the previous embodiment. This signal causes the driver 382 to turn on the feed motor 325 via the OR gate 384 to thereby additionally rotate the feed roller 302. Thus a counter 390 starts to count pulse signals from the pulse sensor 327. When the count of the counter 390 reaches $N_2$ similar to that in the previous embodiment, the output of the counter becomes "0" to thereby turn off the feed motor 325 and stop the feed roller 302.

Lastly, the function of a dip switch 372 provided on the control board 310 of FIG. 22 will now be described. The dip switch 372 is a free run mode switch which when turned on, causes the option tray by itself to feed a sheet of paper.

Figure 24:
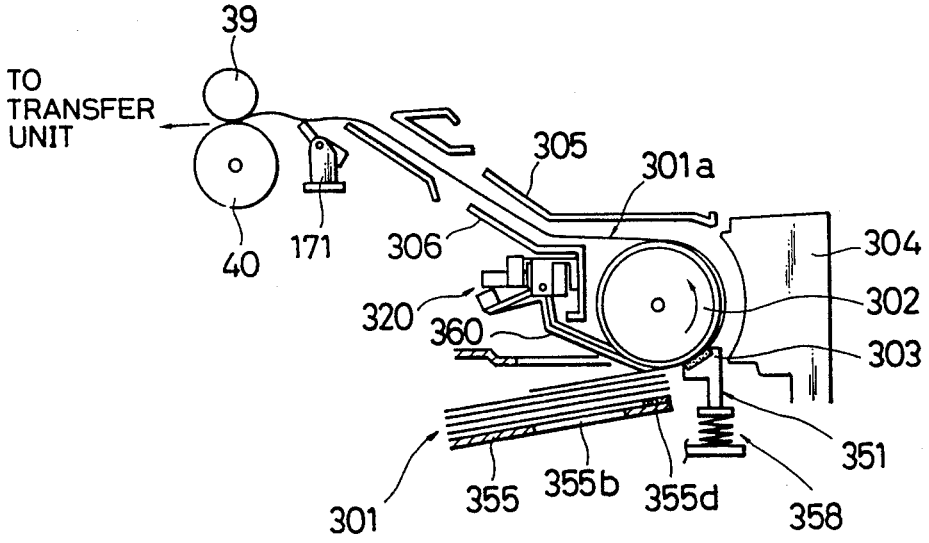
FIG. 24 schematically illustrates the action of the paper feed unit when a sufficient number of sheets of paper is accommodated in the paper cassette.

If the dip switch 372 is turned on even if there is no start command from the printer proper, the feed motor 325 is driven for only a predetermined time interval corresponding to a predetermined number of pulse signals from the pulse sensor 327 to drive the feed roller 302 in the direction of the related arrow in FIG. 24. Thus the uppermost one of the sheets of paper in the feed cassette 300 is fed out to thereby reverse the feed motor 325 for a short time to stop same. After a few seconds of rest, the above operations are repeated. Since the sheet of paper is fed only halfway like when a sheet of paper is fed to the printer proper, it must be removed manually during the resting stage.

By utilizing the free run mode, the operation of the option tray may be by itself tested conveniently even if the option tray is not mounted on the printer proper.

While in the above embodiments, a laser printer to which the present invention is applied has been described and shown, this invention may be similarly applicable to paper feed units of image forming apparatus such as copy machines and printing machines other than the printer.

What is claimed is:

1. An apparatus for forming an image on a sheet of paper, comprising:

a main body;

a storing means for storing sheets of paper therein;

a feeding means for feeding said sheets of paper in said storing means into said main body in a predetermined direction and having a feed roller feeding an uppermost sheet of paper among said sheets of paper in said storing means by a rotation thereof to a predetermined position corresponding to a conveyor roller;

a turn cover disposed on said storing means; and a member fixed at a turn cover at one end thereof such that one sheet of paper present on said feed roller is positioned between said turn cover and the other end of said member for drawing out said one sheet of paper when said turn cover is opened.

2. An apparatus for forming an image on a sheet of paper, comprising:

a main body;

a storing means for storing sheets of paper therein;

a feeding means for feeding said sheets of paper in said storing means into said main body kin a predetermined direction and having a feed roller feeding an uppermost sheet of paper among said sheets of paper in said storing means by a rotation thereof to a predetermined position corresponding to a conveyor roller;

a turn cover disposed on said storing means;

a member fixed at a turn cover at one end thereof such that one sheet of paper present on s aid feed roller is positioned between said turn cover and the other end of said member for drawing out said one sheet of paper when said turn cover is opened; and a resilient plate-like member fixed to said main body at one end thereof and pressing against a leading end portion uppermost sheet of paper in said storing means with respect to said predetermined direction at the other end thereof.

3. An apparatus according to claim 2, in which said body further comprises another storing means for storing another sheets of paper and another feeding means for feeding said another sheets of paper in said another storing means, said another feeding means being adapted to feed said another sheets of paper in a reverse direction of said predetermined direction.

4. An apparatus for forming an image on a sheet of paper, comprising:

a main body;

a storing means having a bottom plate storing sheets of paper;

a feeding means for feeding said sheets of paper on said bottom plate into said main body in predetermined direction and having a feed roller feeding an uppermost sheet of paper among said sheets of paper on said bottom plate by a rotation thereof to a predetermined position corresponding to a conveyor roller; and a driving means for driving said feed roller;

said body having a pressing means for pressing said sheets of paper on said bottom plate against said feed roller through a friction pad disposed at said bottom plate, a first sensing means for sensing that said fed sheet of paper reaches to said predetermined position, a second sensing means for sensing that the last sheet of paper on said bottom plate is fed out, and a controlling means for controlling said driving means such that said feed roller is stopped to allow to rotate freely after said first sensing means senses that said fed sheet of paper reaches to said predetermined position, and that said feed roller is rotated again by means of said driving means by a set time interval or by a set angle after said second sensing means senses that the last sheet of paper on said bottom plate is fed out.

5. An apparatus according to claim 4, in which said body further comprises another storing means for storing another sheets of paper and another feeding means for feeding said another sheets of paper in said another storing means, said another feeding means being adapted to feed said another sheets of paper in a reverse direction of said predetermined direction.

* * * * *